US011794473B2

(12) United States Patent
Bandoh

(10) Patent No.: US 11,794,473 B2
(45) Date of Patent: Oct. 24, 2023

(54) LIQUID DISCHARGE HEAD, DISCHARGE DEVICE, AND LIQUID DISCHARGE APPARATUS

(71) Applicant: Yoshinori Bandoh, Kanagawa (JP)

(72) Inventor: Yoshinori Bandoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 67 days.

(21) Appl. No.: 17/504,510

(22) Filed: Oct. 19, 2021

(65) Prior Publication Data

US 2022/0143977 A1 May 12, 2022

(30) Foreign Application Priority Data

Nov. 9, 2020 (JP) ..... 2020-186763

(51) Int. Cl.
*B41J 2/14* (2006.01)

(52) U.S. Cl.
CPC ..... *B41J 2/14233* (2013.01); *B41J 2/1433* (2013.01); *B41J 2002/14419* (2013.01); *B41J 2002/14459* (2013.01); *B41J 2202/21* (2013.01)

(58) Field of Classification Search
CPC ..... B41J 2/14233; B41J 2/1433; B41J 2002/14419; B41J 2002/14459;
(Continued)

(56) References Cited

U.S. PATENT DOCUMENTS

2005/0219315 A1* 10/2005 Hori ..... B41J 2/14233 347/61
2012/0160925 A1 6/2012 Hoisington et al.
(Continued)

FOREIGN PATENT DOCUMENTS

CN 103635261 A 3/2014
JP 2015-036238 2/2015
(Continued)

OTHER PUBLICATIONS

IP.com search (Year: 2023).*
(Continued)

*Primary Examiner* — Lisa Solomon
(74) *Attorney, Agent, or Firm* — XSENSUS LLP

(57) ABSTRACT

A liquid discharge head includes multiple nozzles arrayed in two-dimensional matrix, the multiple nozzles configured to discharge a liquid, multiple pressure chambers respectively communicating with the multiple nozzles, multiple common-supply branch channels, each communicating with the multiple pressure chambers, multiple common-collection branch channels, each communicating with the multiple pressure chambers, the multiple common-collection branch channels respectively communicating with the multiple common-supply branch channels through the multiple pressure chambers, a common-supply main channel communicating with each of the multiple common-supply branch channels, a common-collection main channel communicating with each of the multiple common-collection branch channels, and two or more bypass channels communicating with the multiple common-supply branch channels and the multiple common-collection branch channels.

6 Claims, 13 Drawing Sheets

(58) Field of Classification Search
CPC ..... B41J 2202/21; B41J 2202/11; B41J 2202/20; B41J 2202/12; B41J 2/14201; B41J 2/01
See application file for complete search history.

(56) References Cited

U.S. PATENT DOCUMENTS

| | | | |
|---|---|---|---|
| 2013/0050346 | A1 | 2/2013 | Takeuchi et al. |
| 2020/0156374 | A1 | 5/2020 | Bandoh |
| 2020/0290348 | A1 | 9/2020 | Kato |
| 2020/0298582 | A1 | 9/2020 | Bandoh |
| 2021/0094298 | A1 | 4/2021 | Bandoh |
| 2021/0260874 | A1 | 8/2021 | Bandoh |

FOREIGN PATENT DOCUMENTS

| | | | |
|---|---|---|---|
| JP | 2016-203556 | | 12/2016 |
| JP | 2016-203614 | | 12/2016 |
| JP | 2019-155836 | | 9/2019 |
| WO | 2015/022833 | A1 | 2/2015 |

OTHER PUBLICATIONS

Extended European Search Report dated Mar. 31, 2022, in corresponding European Application 21202010.1, 9 pp.
Office Action dated Feb. 24, 2023 in Chinese Patent Application No. 202111201819.0, 5 pages.

* cited by examiner

COMPARATIVE EXAMPLE

COMPARATIVE EXAMPLE

LIQUID DISCHARGE HEAD, DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-186763, filed on Nov. 9, 2020, in the Japan Patent Office, the entire disclosures of which is hereby incorporated by reference herein.

BACKGROUND

Technical Field

Aspects of the present disclosure relate to a liquid discharge head, a discharge device, and a liquid discharge apparatus.

Related Art

A liquid discharge head includes multiple nozzles arrayed in a two-dimensional matrix. The liquid discharge head discharge a liquid from the multiple nozzles. The liquid is supplied to a pressure chamber from a common-supply main channel to a pressure chamber through a common-supply branch channel. The liquid is collected from the pressure chamber to a common-collection main channel through a common-collection branch channel.

SUMMARY

In an aspect of this disclosure, a liquid discharge head includes multiple nozzles arrayed in two-dimensional matrix, the multiple nozzles configured to discharge a liquid, multiple pressure chambers respectively communicating with the multiple nozzles, multiple common-supply branch channels, each communicating with the multiple pressure chambers, multiple common-collection branch channels, each communicating with the multiple pressure chambers, the multiple common-collection branch channels respectively communicating with the multiple common-supply branch channels through the multiple pressure chambers, a common-supply main channel communicating with each of the multiple common-supply branch channels, a common-collection main channel communicating with each of the multiple common-collection branch channels, and two or more bypass channels communicating with the multiple common-supply branch channels and the multiple common-collection branch channels. The multiple common-supply branch channels and the multiple common-collection branch channels are disposed alternately in a flow direction of the liquid in the common-supply main channel. The two or more bypass channel includes a first bypass channel communicating with one of the multiple common-supply branch channels and one of the multiple common-collection branch channels, and a second bypass channel communicating with another of the multiple common-supply branch channels and another of the multiple common-collection branch channels, and a fluid resistance of the first bypass channel is different from a fluid resistance of the second bypass channel.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
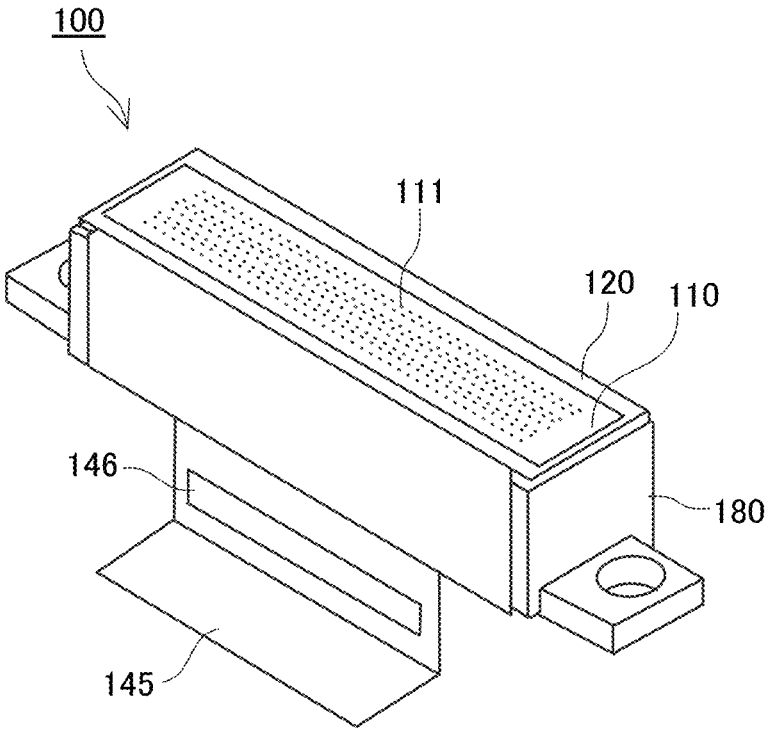
FIG. 1 is an outer perspective view of a liquid discharge head viewed from a nozzle surface side according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

It will also be understood that when an element is referred to as being "connected" or "coupled" to another element, it can be directly connected or coupled to another element or intervening elements may be present. In contrast, when an element is referred to as being "directly connected" or "directly coupled" to another element, there are no intervening elements present.

Referring now to the drawings, wherein like reference numerals designate identical or corresponding parts throughout the several views, embodiments of the present disclosure are described below. A liquid discharge head 100 according to a first embodiment of the present disclosure is described with reference to FIGS. 1 to 6. Hereinafter, the "liquid discharge head" is simply referred to as the "head".

FIG. 1 is an outer perspective view of the head 100 viewed from a nozzle surface side according to the first embodiment.

Figure 2:
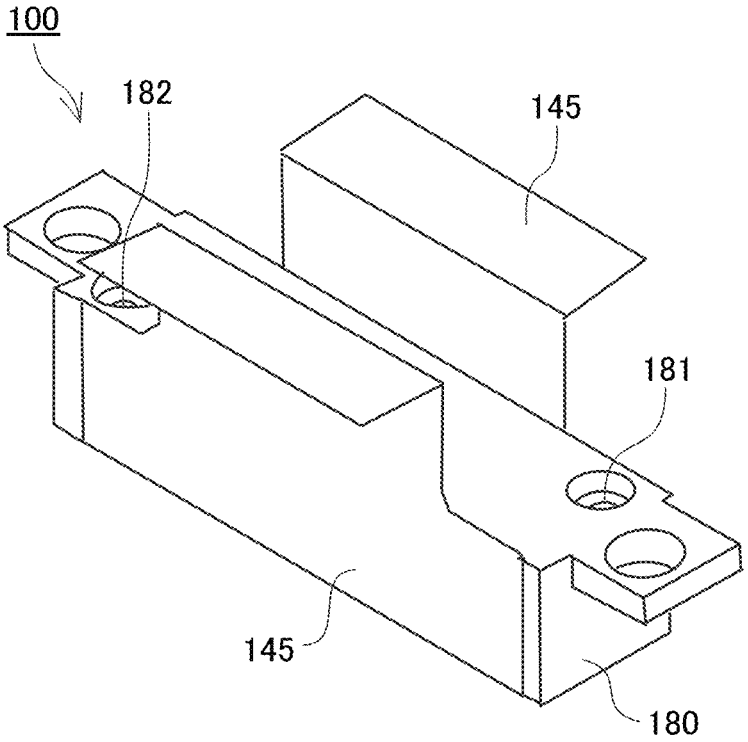
FIG. 2 is an outer perspective view of the liquid discharge head viewed from an opposite side of the nozzle surface side according to the first embodiment of the present disclosure.

FIG. 2 is an outer perspective view of the head 100 viewed from an opposite side of the nozzle surface side according to the first embodiment.

Figure 3:
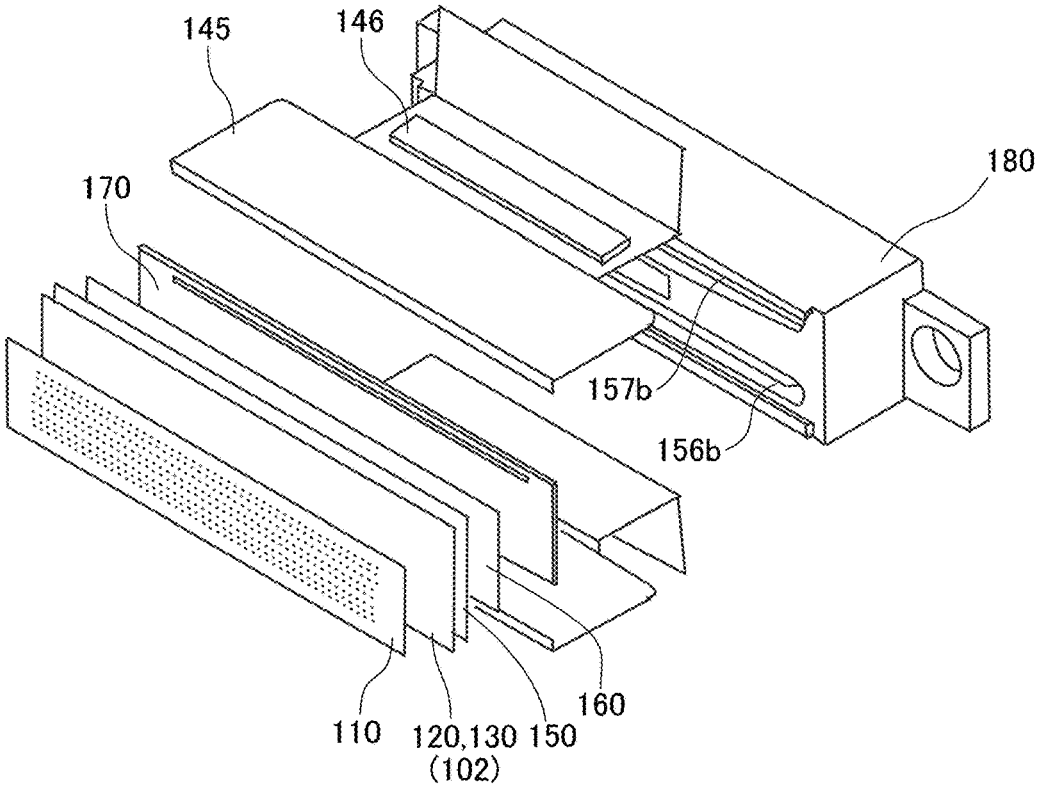
FIG. 3 is an exploded perspective view of a head module according to the first embodiment of the present disclosure.

FIG. 3 is an exploded perspective view of the head 100 of FIG. 1.

Figure 4:
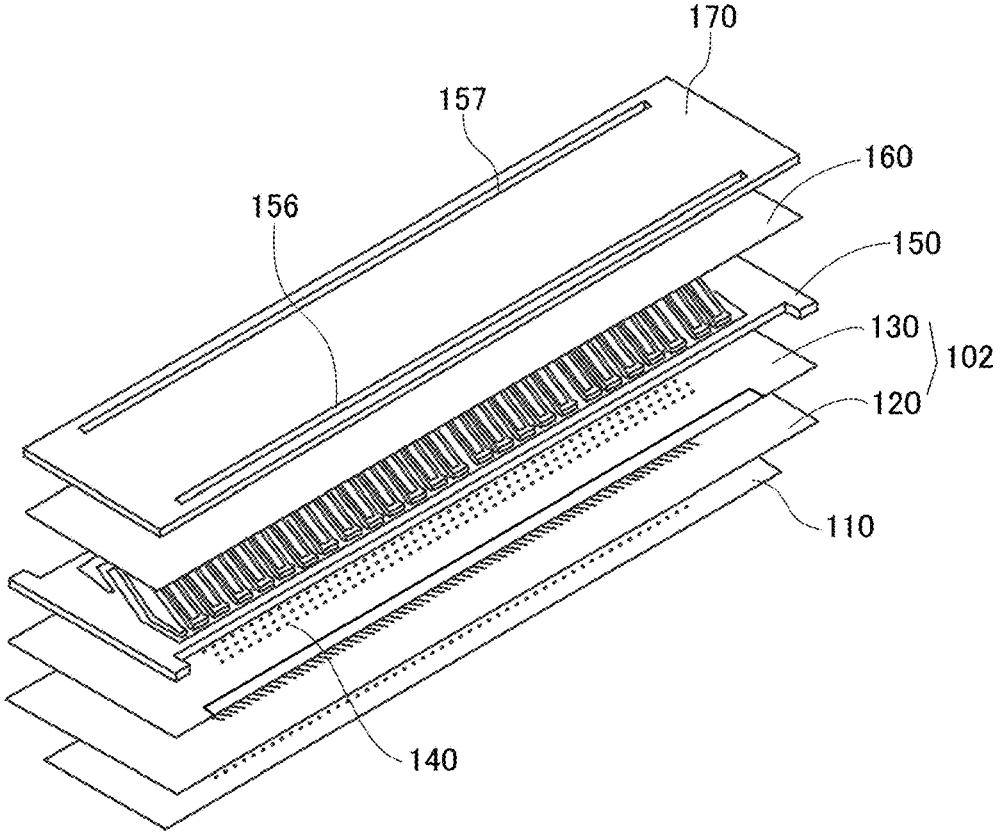
FIG. 4 is an exploded perspective view of a channel forming member of the liquid discharge head according to the first embodiment of the present disclosure.

FIG. 4 is an exploded perspective view of a channel forming member of the head 100 according to the first embodiment.

Figure 5:
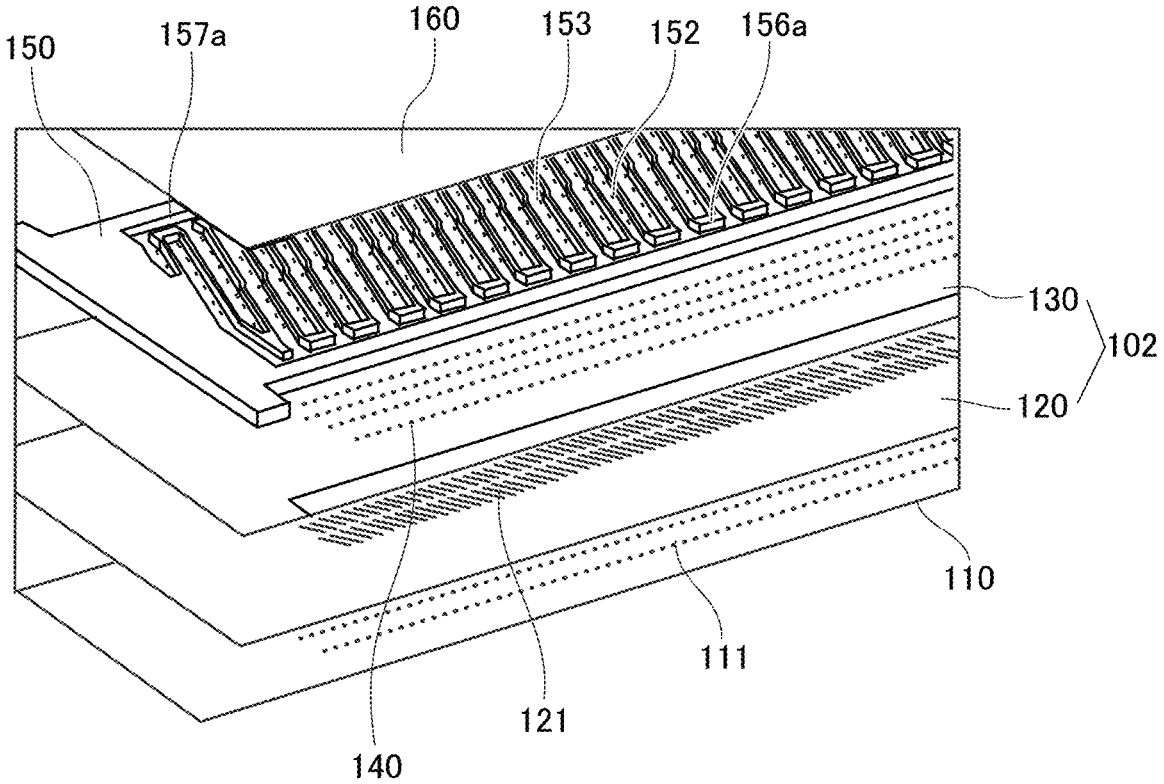
FIG. 5 is an enlarged perspective view of a portion of the channel forming member of FIG. 4.

FIG. 5 is an enlarged perspective view of a portion of the channel forming member of FIG. 4.

Figure 6:
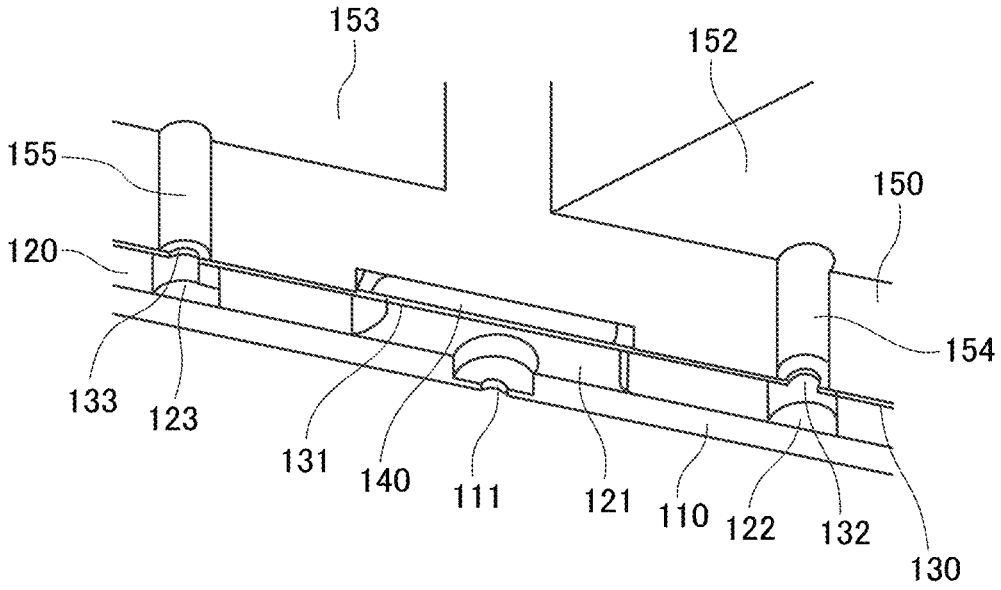
FIG. 6 is a cross-sectional perspective view of channels in the liquid discharge head according to the first embodiment.

FIG. 6 is a cross-sectional perspective view of channels of the channel forming member of the head 100.

The head 100 according to the first embodiment is a circulation-type liquid discharge head. The head 100 includes a nozzle plate 110, a channel plate 120 (individual channel member), a diaphragm member 130, a common-branch channel member 150, a damper 160, a common-main channel member 170, a frame 180, and a flexible wiring 145 (wiring member). The diaphragm member 130 includes piezoelectric elements 140.

The head 100 includes a head driver 146 mounted on the flexible wiring 145 (wiring member). The head driver 146 is also referred to as a "driver integrated circuit (driver IC)". The head 100 in the first embodiment includes an actuator substrate 102 formed by the channel plate 120 (individual channel member) and the diaphragm member 130 (see FIG. 3). The piezoelectric elements 140 are arranged on the diaphragm member 130 of the actuator substrate 102 (see FIGS. 5 and 6).

The nozzle plate 110 includes multiple nozzles 111 to discharge a liquid. The multiple nozzles 111 are arrayed in a two-dimensional matrix.

The channel plate 120 includes multiple pressure chambers 121 (individual chambers) respectively communicating with the multiple nozzles 111, multiple individual supply channels 122 respectively communicating with the multiple pressure chambers 121, and multiple individual collection channels 123 respectively communicating with the multiple pressure chambers 121 (see FIG. 6).

The diaphragm member 130 forms a diaphragm 131 serving as a deformable wall of the pressure chamber 121, and the piezoelectric element 140 is formed on the diaphragm 131 so that the piezoelectric element 140 and the diaphragm 131 form a single body. Further, the diaphragm member 130 includes a supply opening 132 that communicates with the individual supply channel 122 and a collection opening 133 that communicates with the individual collection channel 123 (see FIG. 6). The piezoelectric element 140 is pressure generating device (pressure generating element) that deforms the diaphragm 131 to pressurize the liquid in the pressure chamber 121.

The common-branch channel member 150 includes multiple common-supply branch channels 152 that communicate with two or more individual supply channels 122 and multiple common-collection branch channels 153 that communicate with two or more individual collection channels 123. The multiple common-supply branch channels 152 and the multiple common-collection branch channels 153 are arranged alternately adjacent to each other (see FIG. 5).

As illustrated in FIG. 6, the common-branch channel member 150 includes a through hole serving as a supply port 154 that connects the supply opening 132 of the individual supply channel 122 and the common-supply branch channel 152, and a through hole serving as a collection port 155 that connects the collection opening 133 of the individual collection channel 123 and the common-collection branch channel 153.

The common-branch channel member 150 includes a part 156*a* of one or more common-supply main channels 156 that communicate with the multiple common-supply branch channels 152, and a part 157*a* of one or more common-collection main channels 157 that communicate with the multiple common-collection branch channels 153 (see FIGS. 3 to 5).

As illustrated in FIGS. 5 and 6, the damper 160 includes a supply-side damper that faces (opposes) the supply port 154 of the common-supply branch channel 152 and a collection-side damper that faces (opposes) the collection port 155 of the common-collection branch channel 153.

As illustrated in FIG. 5, the damper 160 seals grooves alternately arrayed in the same common-branch channel member 150 to form the common-supply branch channels 152 and the common-collection branch channels 153. The damper 160 forms a deformable wall of the common-supply branch channels 152 and the common-collection branch channels 153.

The common-main channel member 170 forms a common-supply main channel 156 that communicates with the multiple common-supply branch channels 152 and a common-collection main channel 157 that communicate with the multiple common-collection branch channels 153 (see FIGS. 4 and 5).

The frame 180 includes a part 156*b* of the common-supply main channel 156 and a part 157*b* of the common-collection main channel 157 (see FIG. 3).

The part 156*b* (see FIG. 3) of the common-supply main channel 156 communicates with the supply port 181 (see FIG. 2) in the frame 180. The part 157*b* (see FIG. 3) of the common-collection main channel 157 communicates with the collection port 182 (see FIG. 2) in the frame 180.

In the head 100, when a drive pulse is applied to the piezoelectric element 140, the piezoelectric element 140 is bent and deformed to pressurize the liquid in the pressure chamber 121, so that the liquid is discharged from the nozzle 111 as liquid droplets. Thus, the head 100 is configured to discharge a liquid from the nozzles 111.

When a liquid discharge operation to discharge the liquid from the head 100 is not performed, the liquid which is not discharged from the nozzle 111 circulates through a circulation path to which the collection port 182 and the supply port 181 (see FIG. 2) are connected.

Next, a configuration of a channel configuration of the head 100 according to the first embodiment is described with reference to FIGS. 7 and 8.

Figure 7:
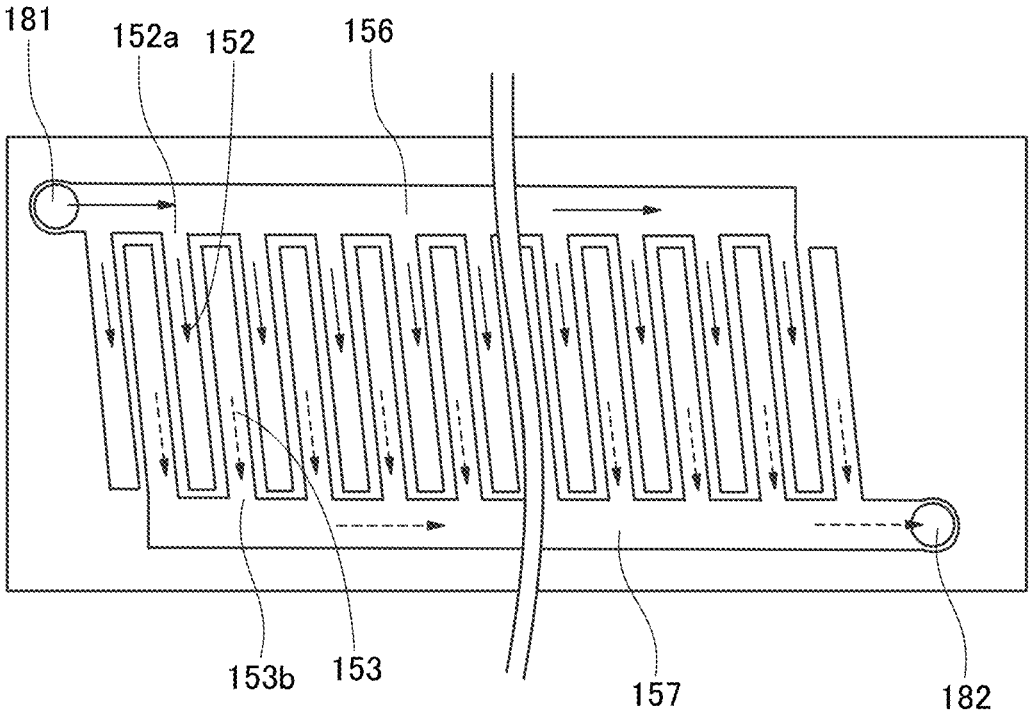
FIG. 7 is a schematic plan view of a common main channel and a common branch channel illustrating a channel configuration of the liquid discharge head according to the first embodiment.

FIG. 7 is a schematic plan view of a common main channel and a common branch channel.

The common main channel includes the common-supply main channel 156 and the common-collection main channel 157. The common branch channel includes the common-supply branch channels 152 and the common-collection branch channels 153.

Figure 8:
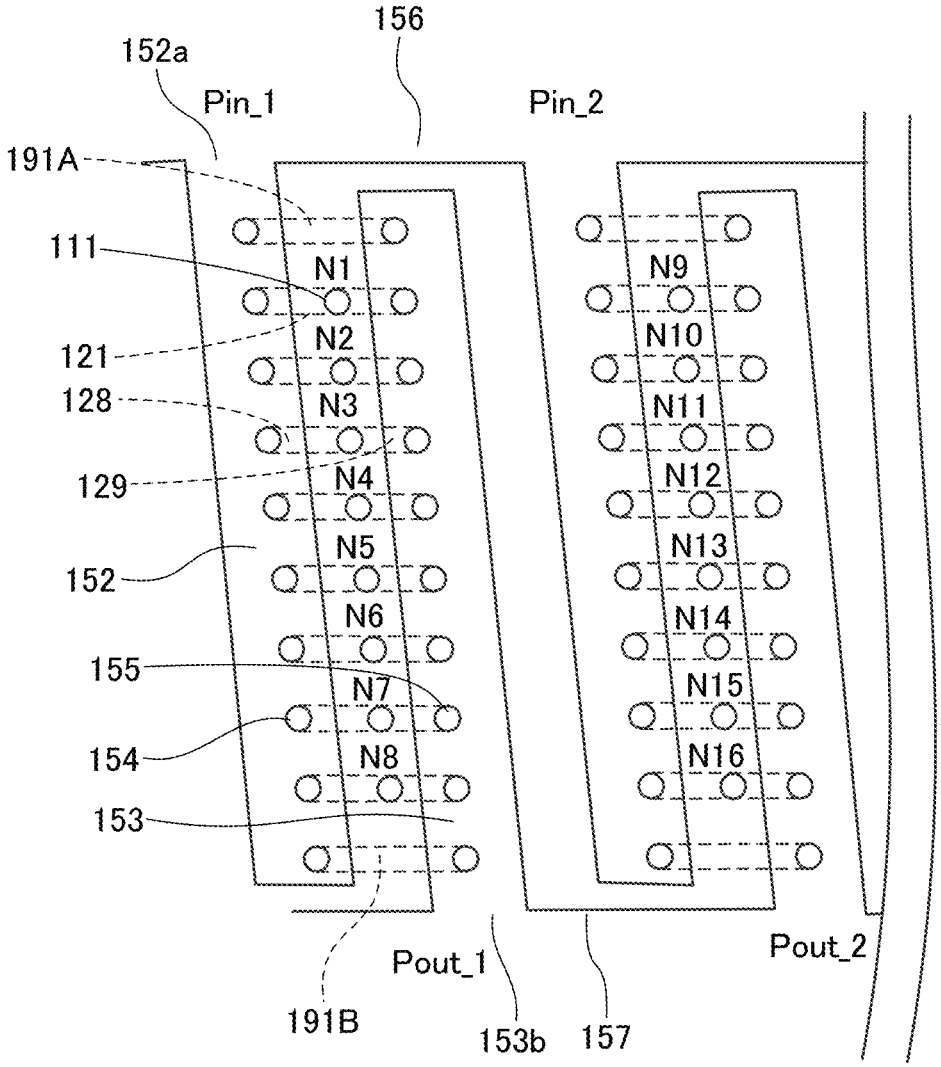
FIG. 8 is a schematic plan view of a main part of a portion related to an individual channel including a common branch channel, a bypass channel, and a pressure chamber.

FIG. 8 is a schematic plan view of a main part of a portion related to an individual channel including a common branch channel, bypass channels 191A and 191B, and the pressure chamber 121.

In FIG. 8, a channel portion from the supply port 154 opened to the common-supply branch channel 152 to the nozzle 111 is defined as a supply-side individual channel 128. In FIG. 8, a channel portion from the nozzle 111 to the collection port 155 opened to the common-collection branch channel 153 is defined as a collection-side individual channel 129. The pressure chamber 121 includes the supply-side individual channel 128 and the collection-side individual channel 129.

Multiple common-supply branch channels 152 are connected to the common-supply main channel 156. Multiple common-collection branch channels 153 are connected to the common-collection main channel 157. The multiple common-supply branch channels 152 and the common-collection branch channels 153 are alternately arranged as illustrated in FIG. 7. Flow directions of the liquid in the common-supply main channel 156 and the common-supply branch channels 152 are indicated by solid arrows in FIG. 7. Flow directions of the liquid in the common-collection main channel 157 and the common-collection branch channels 153 are indicated by dashed arrows.

Each of the multiple pressure chambers 121 extends in the flow direction of the common-supply main channel 156 or extends in a direction parallel to the flow direction of the common-supply main channel 156.

The head 100 includes a bypass channel 191A that connects the common-supply branch channels 152 and the common-collection branch channels 153 adjacent to each other in the flow direction of the common-supply main channel 156 in a vicinity of an inlet 152*a*. The inlet 152*a* is connected to the common-supply main channel 156 of the common-collection branch channels 153. Each of the common-supply branch channel 152 is connected to the common-supply main channel 156 at the inlet 152*a*. Thus, the inlet 152*a* is a joint between the common-supply branch channel 152 and the common-supply main channel 156.

The head 100 includes a bypass channel 191B that connects the common-supply branch channels 152 and the common-collection branch channels 153 adjacent to each other in the flow direction of the common-supply main channel 156 in a vicinity of an outlet 153*b*. The outlet 153*b* is connected to the common-collection main channel 157 of the common-collection branch channels 153. Each of the common-collection branch channel 153 is connected to the common-collection main channel 157 at the outlet 153*b*. Thus, the outlet 153*b* is a joint between the common-collection branch channel 153 and the common-collection main channel 157.

Thus, the head 100 in the first embodiment includes two bypass channels 191A and 191B each communicating with an identical common-supply branch channels 152 and an identical common-collection branch channels 153. The bypass channel 191A becomes an upstream bypass channel and the bypass channel 191B becomes a downstream bypass channel in a flow direction of the common-supply branch channel 152 among the two bypass channels 191A and 191B. The flow direction of the common-supply branch channel 152 is the same as the flow direction of the common-collection branch channels 153 as illustrated in FIG. 7.

As illustrated in FIG. 8, it is assumed that each of eight nozzles 111 communicate with one common-supply branch channel 152 and one common-collection branch channel 153 for simplification. The eight nozzles 111, arranged from the inlet 152*a* of the most upstream common-supply branch channel 152 in the flow direction of the common-supply main channel 156, are designated by nozzle numbers N1 to N8. The eight nozzles 111 arranged from the inlet 152*a* of next common-supply branch channel 152 are designated by nozzle numbers N9 to N16.

A comparative example is described with reference to FIGS. 9 and 10. In the comparative example, a fluid resistance of the bypass channel between different common branch channels are made identical in a channel configuration of the above-described first embodiment.

Figure 9:
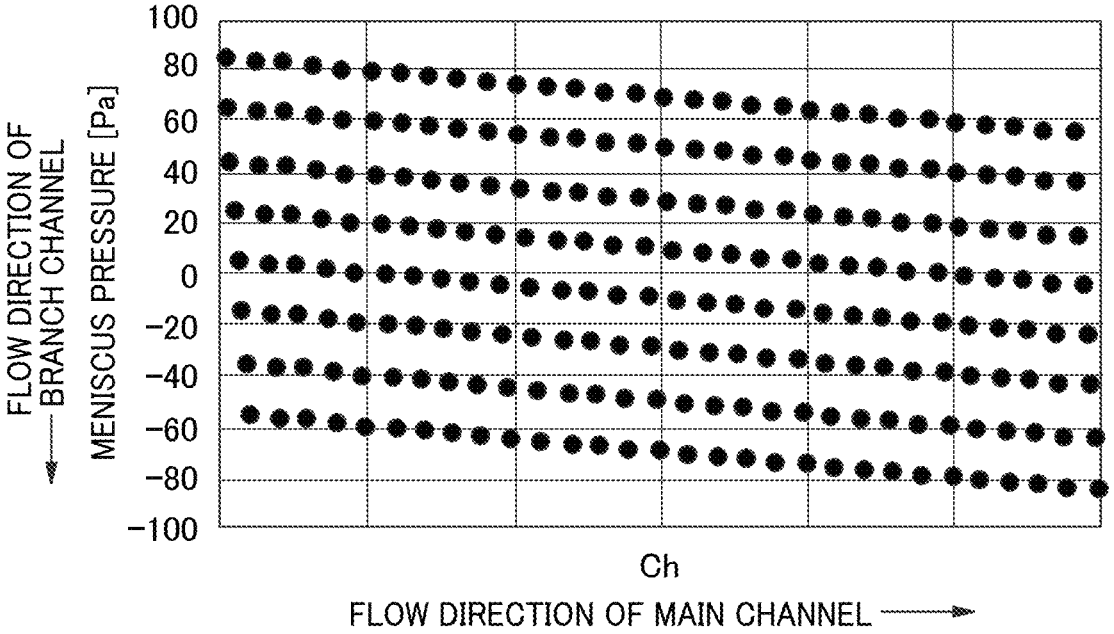
FIG. 9 is a graph illustrating variation in a meniscus pressure in a comparative example.

FIG. 9 is a graph illustrating variation in a meniscus-pressure when the liquid is circulated in a channel configuration in which the fluid resistance of the bypass channels 191 (191A and 191B) are made identical between the different common-supply branch channels 152 and the common-collection branch channels 153.

A horizontal axis in FIG. 9 indicates a nozzle position (channel (Ch)) in the flow direction of the common-supply main channel 156 from the supply port 181 (see FIG. 7). In FIG. 9, the "common-supply main channel 156" is simply referred to as a "main channel". A vertical axis in FIG. 9 indicates eight nozzles 111 arranged in the flow direction in the common-supply branch channel 152.

As illustrated in FIG. 9, the fluid resistance of the bypass channels 191 (191A and 191B) are made identical between the common-supply branch channel 152 and the common-collection branch channel 153 in the comparative example. Then, a variation in meniscus pressure occurs in the flow direction of the common-supply branch channel 152 and in the flow direction of the common-supply main channel 156 in the comparative example as illustrated in FIG. 9.

Figure 10:
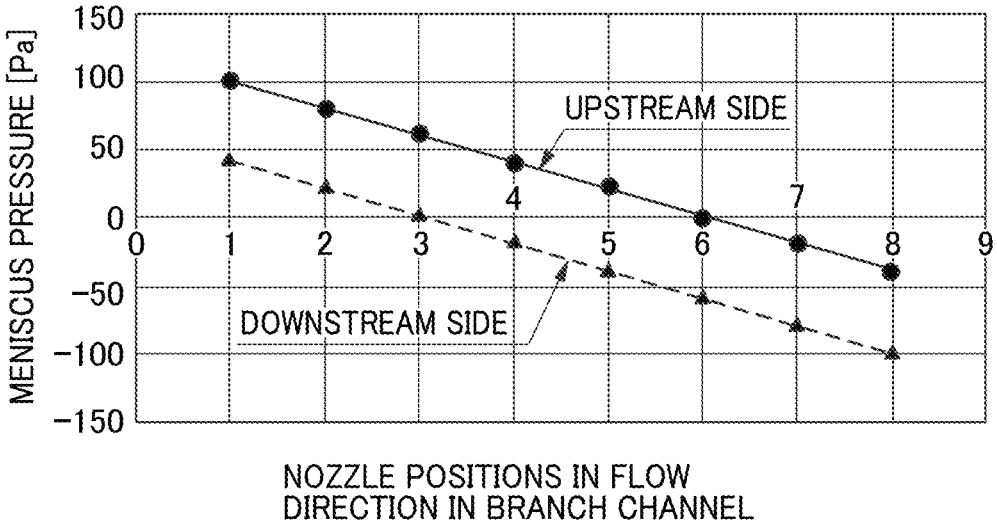
FIG. 10 is a graph illustrating the variation in the meniscus pressure in a comparative example.

FIG. 10 is a graph illustrating a relation between the nozzle position (pressure chamber position) and the meniscus pressure in the flow direction in each branch channel of an upstream-side common-supply branch channel 152 and a downstream-side common-supply branch channel 152 in the flow direction of the common-supply main channel 156. In FIG. 10, the "common-supply branch channel 152" is simply referred to as "branch channel".

As illustrated in FIG. 10, the meniscus pressure of the nozzle 111 communicating with the upstream-side common-supply branch channel 152 in the flow direction of the common-supply main channel 156 is higher than the meniscus pressure of the nozzle 111 communicating with the downstream-side common-supply branch channel 152.

Next, the relation between an adjustment of the fluid resistance of the bypass channel 191 and the meniscus pressure in the first embodiment of the present disclosure is described below with reference to FIG. 11.

Figure 11:
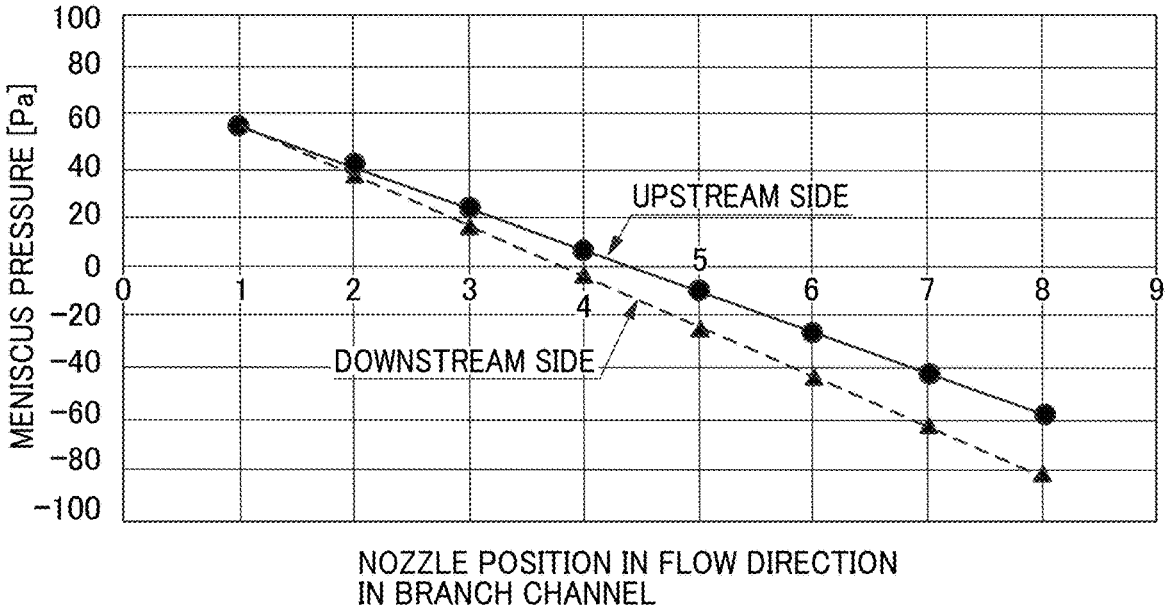
FIG. 11 is a graph illustrating a relation between an adjustment of the fluid resistance of the bypass channel and the meniscus pressure in the first embodiment of the present disclosure.

FIG. 11 is a graph illustrating the adjustment of the fluid resistance in the head 100 according to the first embodiment of the present disclosure.

The head 100 in the first embodiment adjusts the fluid resistance of the bypass channel 191A.

FIG. 11 is a graph illustrating a relation between the nozzle positions (pressure chamber position) and the meniscus pressure in the flow direction in each branch channel of the upstream-side common-supply branch channel 152 and the downstream-side common-supply branch channel 152 in the flow direction of the common-supply main channel 156 when the fluid resistance of the bypass channel 191A is adjusted. In FIG. 10, the "common-supply branch channel 152" is simply referred to as "branch channels".

In FIG. 11, the head 100 includes the bypass channel 191A (see FIG. 8), a fluid resistance of which is adjusted. The bypass channel 191A communicates with the upstream-side common-supply branch channel 152 and the upstream-side common-collection branch channel 153 in the flow direction of the common-supply main channel 156.

Thus, the head 100 in the first embodiment includes the bypass channel 191A having a fluid resistance different from a fluid resistance of the other bypass channels 191A among multiple bypass channels 191A communicating with different common-supply branch channels 152 and common-collection branch channels 153 in the flow direction of the common-supply main channel 156.

As illustrated in FIG. 11, the meniscus pressure of the nozzle 111 communicating with the upstream-side common-supply branch channel 152 in the flow direction of the common-supply main channel 156 in the first embodiment becomes lower than the meniscus pressure of the nozzle 111 communicating with the upstream-side common-supply branch channel 152 in the comparative example as illustrated in FIG. 10. The meniscus pressure of the nozzle 111 communicating with the upstream-side common-supply branch channel 152 becomes close to the meniscus pressure of the nozzle 111 communicating with the downstream-side common-supply branch channel 152 in the first embodiment.

Thus, an adjustment of the fluid resistance of the bypass channel 191A of the head 100 is applied to the entire head 100 to reduce a difference in the meniscus pressure between the common branch channels in the flow direction of the common main channel in the head 100 according to the first embodiment.

A change of the meniscus pressure and an adjustment amount of the fluid resistance of the bypass channel 191 when the fluid resistance of the bypass channel 191 is varied are described with reference to FIGS. 12 to 14.

Figure 12:
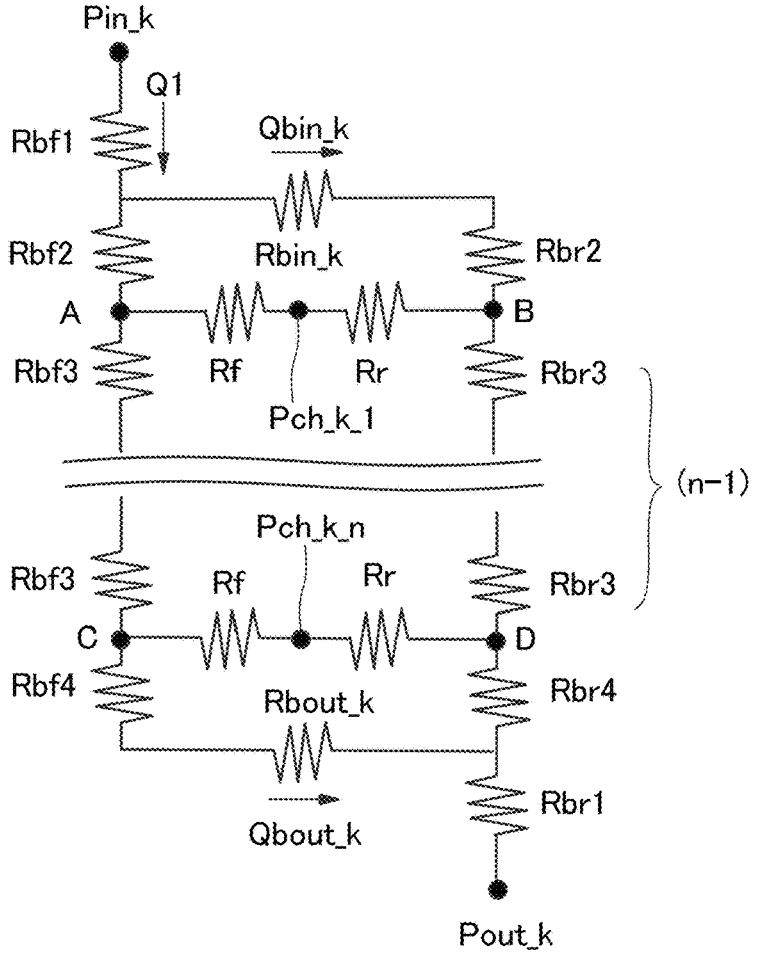
FIG. 12 is an equivalent circuit diagram of the liquid discharge head of FIG. 11 from a common-supply branch channel to a common-collection branch channel.

FIG. 12 is an equivalent circuit diagram from the common-supply branch channel 152 to the common-collection branch channel 153.

Figure 13:
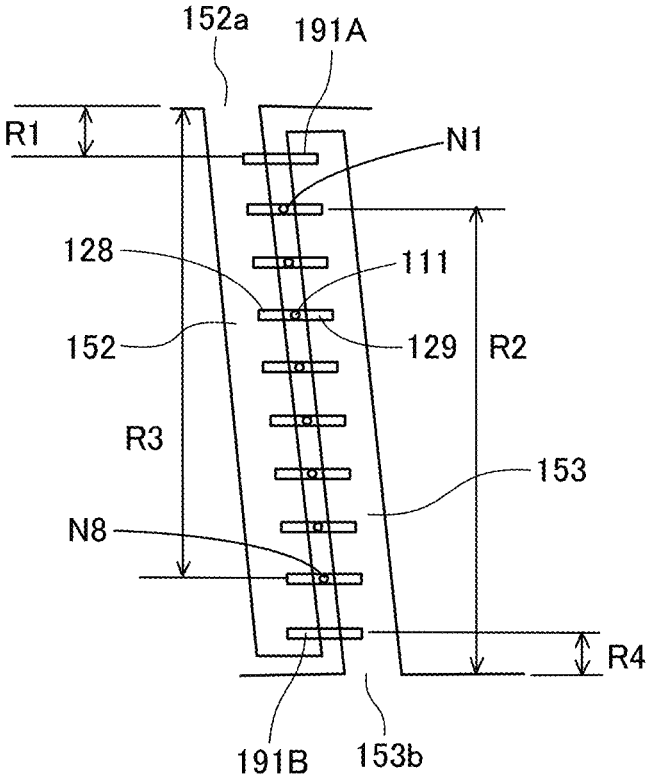
FIG. 13 is a schematic plan view of a portion of the common-supply branch channels, the common-collection branch channels, and the bypass channels illustrating symbols of the equivalent circuit.

FIG. 13 is a schematic plan view of a portion of the common-supply branch channels 152, the common-collection branch channels 153, and the bypass channels 191 illustrating symbols of an equivalent circuit.

Figure 14:
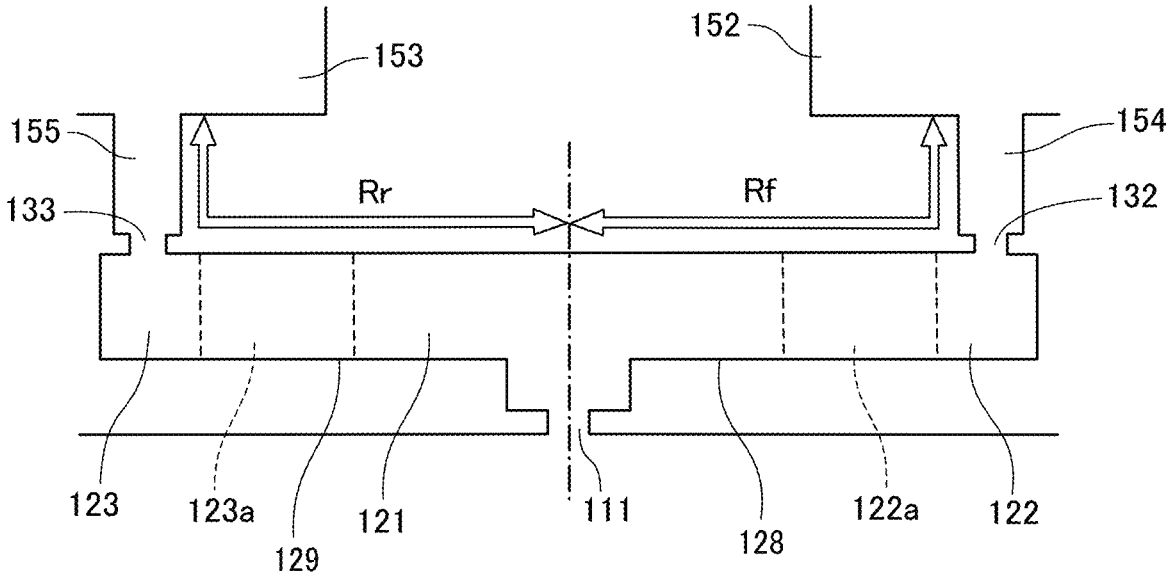
FIG. 14 is an enlarged cross-sectional side view of channels of the liquid discharge head.

FIG. 14 is an enlarged cross-sectional side view of channels of the head 100.

In FIG. 14, a channel portion from the supply port 154 opened to the common-supply branch channel 152 to the nozzle 111 in FIG. 14 is defined as a supply-side individual channel 128 illustrated in FIG. 13.

In FIG. 14, a channel portion from the nozzle 111 to the collection port 155 opened to the common-collection branch channel 153 in FIG. 14 is defined as a collection-side individual channel 129 illustrated in FIG. 13. The pressure chamber 121 includes the supply-side individual channel 128 and the collection-side individual channel 129.

In FIG. 12, Pin_k is a pressure of the inlet 152*a* of the k-th common-supply branch channel 152. The inlet 152*a* is a junction between the k-th common-supply branch channel 152 and the common-supply main channel 156 as illustrated in FIGS. 8 and 12.

Pout_k is a pressure at the outlet 153*b* of the common-collection branch channel 153 connected to the k-th common-supply branch channel 152. The outlet 153*b* is a junction between the common-collection branch channel 153 and the common-collection main channel 157 as illustrated in FIGS. 8 and 12.

Pch_k_n is a meniscus pressure of a n-th nozzle 111 from the inlet 152*a* of the common-supply branch channel 152 connected to the k-th common-supply branch channel 152 as illustrated in FIGS. 8 and 12.

Q1_k is a flow rate at the inlet 152*a* of the k-th common-supply branch channel 152 as illustrated in FIGS. 8 and 12.

Qbin_k is a flow rate of the bypass channel 191A connected to the k-th common-supply branch channel 152 as illustrated in FIGS. 8 and 12.

Qbout_k is a flow rate of the bypass channel 191B connected to the k-th common-supply branch channel 152 as illustrated in FIGS. 8 and 12.

Rbf1 is a fluid resistance from the inlet 152*a* of the common-supply branch channel 152 to the bypass channel 191A as illustrated in FIGS. 8 and 12.

Rbf2 is a fluid resistance from the bypass channel 191A in the common-supply branch channel 152 to the most upstream supply-side individual channel 128 as illustrated in FIGS. 8 and 12.

Rbf3 is a fluid resistance between the supply-side individual channels 128 in the common-supply branch channel 152 as illustrated in FIGS. 8 and 12.

Rbf4 is a fluid resistance from the supply-side individual channel 128 in the common-supply branch channel 152 to the bypass channel 191B as illustrated in FIGS. 8 and 12.

Rbr1 is a fluid resistance from the bypass channel 191B in the common-collection branch channel 153 to the outlet 153*b*. The outlet 153*b* is a junction between the common-collection branch channel 153 and the common-collection main channel 157 as illustrated in FIGS. 8 and 12.

Rbr2 is a fluid resistance from the bypass channel 191A in the common-collection branch channel 153 to the most upstream collection-side individual channel 129 (channel communicating with the nozzle number N1) as illustrated in FIGS. 8 and 12.

Rbr3 is a fluid resistance between the collection-side individual channels 129 in the common-collection branch channel 153 as illustrated in FIGS. 8 and 12.

Rbr4 is a fluid resistance from the most downstream collection-side individual channel 129 (channel communicating with the nozzle number N8) in the common-collection branch channel 153 to the bypass channel 191B as illustrated in FIGS. 8 and 12.

Rbin_k is a fluid resistance of the bypass channel 191A communicating with the k-th common-supply branch channel 152 as illustrated in FIGS. 8 and 12.

Rbout_k is a fluid resistance of the bypass channel 191B communicating with the k-th common-supply branch channel 152 as illustrated in FIGS. 8 and 12.

Rf is the fluid resistance from the common-supply branch channel 152 to the nozzle 111 (see FIG. 14).

Rr is a fluid resistance from the nozzle 111 to the common-collection branch channel 153 (see FIG. 14).

PA, PB, PC and PD are pressures at points A, B, C and D.

In FIG. 13, R1 is a fluid resistance from the inlet 152*a* of the common-supply branch channel 152 to an upstream-side bypass channel 191A.

R2 is a fluid resistance from the most upstream collection-side individual channel 129 (channel communicating with the nozzle number N1) to the outlet 153*b* of the common-collection branch channel 153. The most upstream collection-side individual channel 129 communicates with the common-collection branch channel 153.

R3 is a fluid resistance from the inlet 152*a* of the common-supply branch channel 152 to the most downstream supply-side individual channel 128 (channel communicating with the nozzle number N8).

R4 is a fluid resistance from the downstream bypass channel 191B to the outlet 153*b* of the common-collection branch channel 153.

The common-supply main channel 156 and the common-collection main channel 157 extend in the flow direction of the common-supply main channel 156, and the multiple common-supply branch channels 152 and the multiple common-collection branch channels 153 extend in another flow direction different from the flow direction.

Each of one end of the multiple common-supply branch channels 152 is connected to the common-supply main channel 156 at an inlet 152*a*, and each of one end of the multiple common-collection branch channels 153 is connected to the common-collection main channel 157 at an outlet 153*b*.

Each of another end of the multiple common-supply branch channels 152 is in a vicinity of the common-collection main channel 157, and the multiple common-supply branch channels 152 are configured to flow the liquid from the inlet 152*a* toward said another end of the multiple common-supply branch channels 152 in said another flow direciton.

Each of another end of the multiple common-collection branch channels 153 is in a vicinity of the common-supply main channel 156, the multiple common-collection branch channels 153 are configured to flow the liquid from said another end of the multiple common-collection branch channels 153 toward the outlet 153*b* in said another flow direction.

First, a change in the meniscus pressure when the fluid resistance Rbin_k of the bypass channel 191A is changed is described below.

When the fluid resistance Rbin_k of the bypass channel 191A changes, the flow rate Qbin_k of the bypass channel 191A changes by ΔQbin_k. At this time, the pressures PA changes by −ΔQbin_k×Rbf1, and the pressure PB changes by ΔQbin_k×{Rbr1+Rbr3×(n−1)+Rbr4}, respectively.

Accordingly, the meniscus pressure Pch_k_1 changes by ΔQbin_k×[Rf×{Rbr1+Rbr3×(n−1)+Rbr4}−Rr×Rbf1]/(Rf+Rr). That is, the meniscus pressure Pch_k_1 is changed by the fluid resistance Rbin_k of the bypass channel 191A.

Next, an adjustment of the fluid resistance of the bypass channel 191A in the first embodiment is described below.

In the head 100 according to the first embodiment, the meniscus pressure Pch_a_1 becomes lower than an original value (FIG. 10) when an "a-th" is referred as an upstream side and "b-th" is referred as a downstream side in the flow direction of the common-supply main channel 156.

That is, the fluid resistance Rbin_k of the bypass channel 191A is adjusted so that (Qbin_a−Qbin_b)×[Rf×{Rbr1+Rbr3×(n−1)+Rbr4}−Rr×Rbf1] becomes negative. At this time, the fluid resistance Rbin_k of the bypass channel 191A is changed so that (Rbin_a−Rbin_b)×[Rf×{Rbr1+Rbr3×(n−1)+Rbr4}−Rr×Rbf1] becomes positive.

ΔP is set as Pch_b_1−Pch_a_1=ΔP when a result illustrated in FIG. 10 is obtained. Then, the fluid resistance Rbin_a of the bypass channel 191A is set so that Qbin_a=Qbin_b+ΔP×(Rf+Rr)/[Rf×{Rbr1+Rbr3×(n−1)+Rbr4}−Rr×Rbf1] is satisfied in the first embodiment. Thus, the meniscus pressure Pch_a_1 becomes equal to the meniscus pressure Pch_b_1 as illustrated in FIG. 12.

The fluid resistance Rbin_a of the bypass channel 191A at this time is approximately Rbin_a=[Qbin_b×Rbin_b×[Rf×{Rbr1+Rbr3×(n−1)+Rbr4}−Rr×Rbf1]−ΔP×(Rf+Rr)×{Rbr1+Rbr2+Rbr3×(n−1)+Rbr4+Rbf1}]/[Qbin_b×[Rf×{Rbr1+Rbr3×(n−1)+Rbr4}−Rr×Rbf1]+AP×(Rf+Rr)].

Thus, the head 100 according to the first embodiment can reduce variations in meniscus pressure.

[Rf×{Rbr1+Rbr3×(n−1)+Rbr4}−Rr×Rbf1] is a positive value. That is, [{Rbr1+Rbr3×(n−1)+Rbr4}/Rbf1] is preferably can be set large. It is preferable that a distance from the inlet 152*a* in the common-supply branch channel 152 to the bypass channel 191A is short, and it is preferable that the fluid resistance Rbf1 is small to reduce a size of the head 100.

In other words, [{Rbr1+Rbr3×(n−1)+Rbr4}/Rbf1] is preferably can be set large. A condition in which the maximum takeable value of [{Rbr1+Rbr3×(n−1)+Rbr4}/Rbf1] is not restricted by (Rr/Rf) is preferable.

A magnitude relation between the fluid resistance Rbin_a and the fluid resistance Rbin_b becomes Rbin_a>Rbin_b. The fluid resistance Rbin_a is a fluid resistance of an upstream-side bypass channel 191A in the flow direction of the common-supply main channel 156. The fluid resistance Rbin_b is a fluid resistance of a downstream-side bypass channel 191A in the flow direction of the common-supply main channel 156. Thus, the fluid resistance Rbin of the bypass channel 191A communicating with the common-supply branch channel 152 connected to the upstream-side common-supply main channel 156 is larger than the fluid resistance Rbin of the bypass channel 191A communicating with the common-supply branch channel 152 connected to the downstream-side common-supply main channel 156.

In the above description, {Rbr1+Rbr3×(n−1)+Rbr4} is the fluid resistance R2, and the fluid resistance Rbf1 is the fluid resistance R1 as illustrated in FIG. 13.

Thus, a relation of Rf×R2−Rr×R1>0 is satisfied. Thus, the head 100 that satisfies this relation of Rf×R2−Rr×R1>0 can reduce a variation in the meniscus pressure.

Next, the head 100 according to a second embodiment of the present disclosure is described with reference to FIG. 15.

Figure 15:
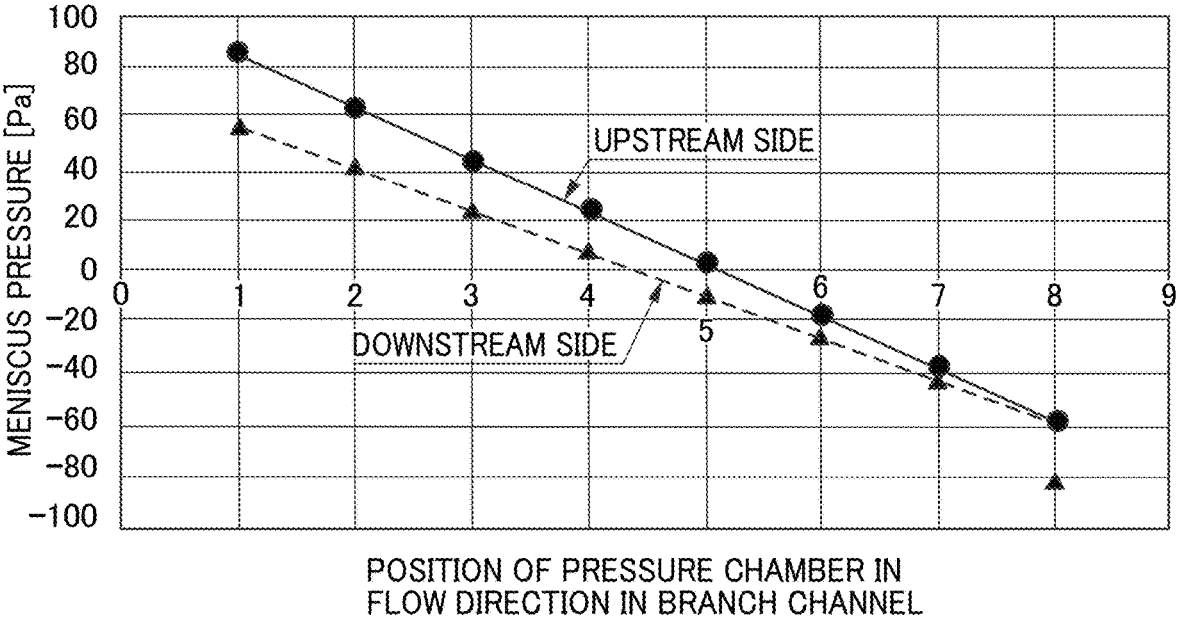
FIG. 15 is a graph illustrating a relation between an adjustment of the fluid resistance of the bypass channel and the meniscus pressure according to a second embodiment of the present disclosure.

FIG. 15 is a graph illustrating a relation between an adjustment of the fluid resistance of the bypass channel 191 and the meniscus pressure.

The channel configuration of the head 100 according to the second embodiment is the same as the channel configuration of the head 100 in the first embodiment. The head 100 in the second embodiment adjusts the fluid resistance of the bypass channel 191B.

FIG. 15 is a graph illustrating a relation between the nozzle position (pressure chamber position) and the meniscus pressure in the flow direction in each branch channel of the upstream-side common-supply branch channel 152 and the downstream side common-supply branch channel 152 in the flow direction of the common-supply main channel 156 when the fluid resistance of the bypass channel 191B is adjusted.

In FIG. 15, the "common-supply branch channel 152" is simply referred to as "branch channel".

In FIG. 15, the head 100 includes the bypass channel 191B (see FIG. 8), a fluid resistance of which is adjusted. The bypass channel 191B communicates with the downstream-side common-supply branch channel 152 and the downstream-side common-collection branch channel 153 in the flow direction of the common-supply main channel 156.

Thus, the head 100 in the second embodiment includes the bypass channel 191B having a fluid resistance different from a fluid resistance of other bypass channels 191B among multiple bypass channels 191B communicating with different common-supply branch channels 152 and common-collection branch channels 153 in the flow direction of the common-supply main channel 156.

As illustrated in FIG. 15, the meniscus pressure of the nozzle 111 communicating with the downstream-side common-supply branch channel 152 in the flow direction of the common-supply main channel 156 in the second embodiment becomes higher than the meniscus pressure of the nozzle 111 communicating with the downstream-side common-supply branch channel 152 in the comparative example as illustrated in FIG. 10. The meniscus pressure of the nozzle 111 communicating with the downstream-side common-supply branch channel 152 becomes close to the meniscus pressure of the nozzle 111 communicating with the upstream-side common-supply branch channel 152 in the second embodiment.

Thus, an adjustment of the fluid resistance of the bypass channel 191B of the head 100 is applied to the entire head 100 to reduce a difference in the meniscus pressure between the common branch channels in the flow direction of the common main channel in the head 100 according to the second embodiment.

First, a change in the meniscus pressure when the fluid resistance Rbout_k of the bypass channel 191B is changed is described below.

When the fluid resistance Rbout_k of the bypass channel 191B changes, the flow rate Qbout_k of the bypass channel 191B changes by ΔQbout_k. The pressure PC changes by −ΔQbout_k×{Rbf1+Rbf2+Rbf3×(n−1)}. The pressure PD changes by ΔQbout_k×Rbr1.

Accordingly, the meniscus pressure Pch_k_n changes by ΔQbout_k×[Rf×Rbr1−Rr×{Rbf1+Rbf2+Rbf3×(n−1)}]/(Rf+Rr). That is, the meniscus pressure Pch_k_n is changed by the fluid resistance Rbout_k of the bypass channel 191B.

Next, an adjustment of the fluid resistance of the bypass channel 191B in the second embodiment is described below.

In the head 100 according to the second embodiment, the meniscus pressure Pch_b_1 becomes higher than an original value (FIG. 10) when an "a-th" is referred as an upstream side and "b-th" is referred as a downstream side in the flow direction of the common-supply main channel 156.

That is, the fluid resistance Rbout_K of the bypass channel 191B is adjusted so that (Qbout_b−Qbout_a)×[Rf×Rbr1−Rr×{Rbf1+Rbf2+Rbf3×(n−1)}] becomes positive. At this time, the fluid resistance Rbout_k of the bypass channel 191B is changed so that (Rbout_b−Rbout_a)×[Rf×Rbr1−Rr×{Rbf1+Rbf2+Rbf3×(n−1)}] becomes negative.

ΔP is set as Pch_a_n−Pch_b_n=ΔP when the result illustrated in FIG. 10 is obtained. Then, the fluid resistance Rbout_b of the bypass channel 191B is set so that Qbout_b=Qbout_a+ΔP×(Rf+Rr)/[Rf×Rbr1−Rr×{Rbf1+Rbf2+Rbf3×(n−1)}] is satisfied in the second embodiment. Thus, the meniscus pressure Pch_a_n becomes equal to the meniscus pressure Pch_b_n as illustrated in FIG. 15.

The fluid resistance Rbout_b of the bypass channel 191B at this time is approximately Rbout_b=[Qbout_a×Rbout_a×[Rf×Rbr1−Rr×{Rbf1+Rbr2+Rbr3×(n−1)}]−ΔP×(Rf+Rr)×{Rbf1+Rbf2+Rbf3×(n−1)+Rbf4+Rbr1}]/[Qbout_a×[Rf×Rbr1−Rr×{Rbf1+Rbr2+Rbr3×(n−1)}]+ΔP×(Rf+Rr)].

Thus, the head 100 according to the second embodiment can reduce variations in meniscus pressure.

[Rf×Rbr1−Rr×{Rbf1+Rbf2+Rbf3×(n−1)}] is preferably a negative value. That is, it is preferable that [{Rbf1+Rbf2+Rbf3×(n−1)}/Rbr1]>(Rr/Rf).

It is preferable that a distance from the bypass channel 191B to the outlet 153*b* in the common-collection branch channel 153 is short, and it is preferable that the fluid resistance Rbr1 is small to reduce a size of the head 100.

In other words, [{Rbf1+Rbf2+Rbf3×(n−1)}/Rbr1] is preferably can be set large. A condition in which the maximum takeable value of [{Rbf1+Rbf2+Rbf3×(n−1)}/Rbr1] is not restricted by (Rr/Rf) is preferable.

The magnitude relationship between the fluid resistance Rbout_a of the bypass channel 191B and the fluid resistance Rbout_b of the bypass channel 191B in the flow direction of the common-supply main channel 156 at this time becomes Rbout_a<Rbout_b. That is, the fluid resistance of the bypass channel 191B communicating with the common-supply branch channel 152 connected to the downstream-side common-supply main channel 156 is larger than the fluid resistance Rbout of the bypass channel 191B communicating with the common-supply branch channel 152 connected to the upstream-side common-supply main channel 156.

In the above description, the fluid resistance Rbr1 is the fluid resistance R4, and {Rbf1+Rbf2+Rbf3×(n−1)} is the fluid resistance R3 as illustrated in FIG. 13.

Thus, a relation of Rf×R4−Rr×R3<0 is satisfied. Thus, the head 100 that satisfies this relation of Rf×R4−Rr×R3<0 can reduce a variation in the meniscus pressure.

Next, the head 100 according to a third embodiment of the present disclosure is described with reference to FIG. 16.

Figure 16:
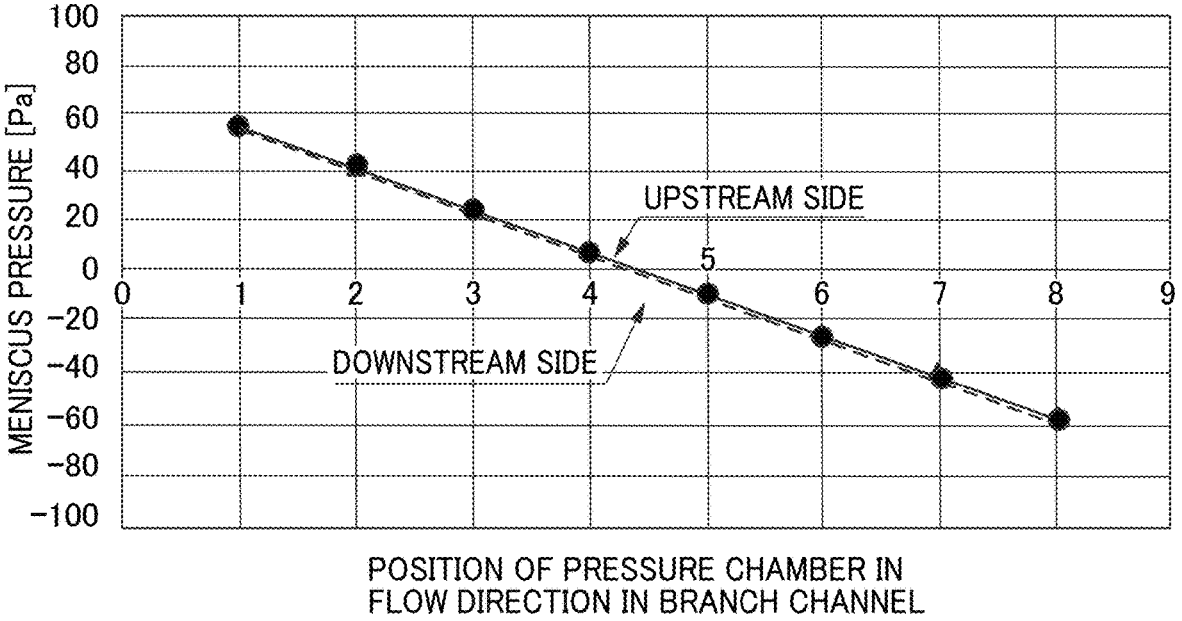
FIG. 16 is a graph illustrating a relation between an adjustment of the fluid resistance of the bypass channel and the meniscus pressure according to a third embodiment of the present disclosure.

FIG. 16 is a graph illustrating a relation between an adjustment of the fluid resistance of the bypass channel 191 and the meniscus pressure.

The channel configuration of the head 100 according to the second embodiment is the same as the channel configuration of the head 100 in the first embodiment. The head 100 in the third embodiment adjusts the fluid resistance of the bypass channel 191A and the bypass channel 191B.

FIG. 16 is a graph illustrating a relation between the nozzle position (pressure chamber position) and the meniscus pressure in the flow direction in each branch channel of the upstream-side common-supply branch channel 152 and the downstream-side common-supply branch channel 152 in the flow direction of the common-supply main channel 156 when the fluid resistance of the bypass channel 191A is adjusted. In FIG. 16, the "common-supply branch channel 152" is simply referred to as "branch channel".

In the head 100 according to the third embodiment, an adjustment is made on the fluid resistance of the bypass channel 191A, which communicates with the upstream-side common-supply branch channel 152 and the common-collection branch channel 153 in the flow direction of the common-supply main channel 156, and the fluid resistance of the bypass channel 191B, which communicates with the downstream-side common-supply branch channel 152 and the common-collection branch channel 153 in the flow direction of the common-supply main channel 156.

Thus, the head 100 in the third embodiment includes the bypass channel 191A having fluid resistance different from fluid resistance of other bypass channels 191A among multiple bypass channels 191A communicating with different common-supply branch channels 152 and common-collection branch channels 153 in the flow direction of the common-supply main channel 156. Further, the head 100 in the third embodiment includes the bypass channel 191B having fluid resistance different from fluid resistance of other bypass channels 191B among multiple bypass channels 191B communicating with different common-supply branch channels 152 and common-collection branch channels 153 in the flow direction of the common-supply main channel 156.

Thus, the fluid resistance Rbin of the bypass channel 191A communicating with the common-supply branch channel 152 connected to the upstream-side common-supply main channel 156 is larger than the fluid resistance Rbin of the bypass channel 191A communicating with the common-supply branch channel 152 connected to the downstream-side common-supply main channel 156.

Further, the fluid resistance of the bypass channel 191B communicating with the common-supply branch channel 152 connected to the downstream-side common-supply main channel 156 is larger than the fluid resistance Rbout of the bypass channel 191B communicating with the common-supply branch channel 152 connected to the upstream-side common-supply main channel 156.

As illustrated in FIG. 16, the head 100 according to the third embodiment reduces a difference between the meniscus pressure of the nozzle 111 communicating with the upstream-side common-supply branch channel 152 and the meniscus pressure of the nozzle 111 communicating with the downstream-side common-supply branch channel 152 in the flow direction of the common-supply main channel 156 compared with the comparative example illustrated in FIG. 10.

Thus, an adjustment of the fluid resistance of the bypass channels 191A and 191B of the head 100 is applied to the entire head 100 to reduce a difference in the meniscus pressure between the common branch channels in the flow direction of the common main channel in the head 100 according to the third embodiment.

Next, an adjustment of the fluid resistance of the bypass channels 191A and 191B in the third embodiment is described below.

In the head 100 according to the third embodiment, an amount of change in a flow rate Qbin_a with respect to that of FIG. 10 is referred to as "ΔQbin_a", and an amount of change in a flow rate Qbout_b with respect to that of FIG. 10 is referred to as "ΔQbout_b" when an "a-th" is referred as an upstream side and "b-th" is referred as a downstream side in the flow direction of the common-supply main channel 156.

At this time, amount of change ΔPch_a_1, ΔPch_a_n, ΔPch_b_1, and ΔPch_b_n of the meniscus pressures Pch_a_1, Pch_a_n, Pch_b_1, and Pch_b_n can be expressed as follows.

$$\Delta Pch_a_1=\Delta Q\text{bin}_a\times\{Rf\times(Rbr1+Rbr3\times n+Rbr4)-Rr\times Rbf1\}/(Rf+Rr).$$

$$\Delta Pch_a_n=\Delta Q\text{bin}_a\times\{Rf\times(Rbr1+Rbr4)-Rr\times Rbf1\}/(Rf+Rr).$$

$$\Delta Pch_b_1=\Delta Q\text{bout}_b\times\{Rf\times Rbr4-Rr\times(Rbf1+Rbf1)\}/(Rf+Rr).$$

$$\Delta Pch_b_n=\Delta Q\text{bout}_b\times[Rf\times Rbr4-Rr\times\{Rbf1+Rbf2+Rbf3\times(n-1)\}]/(Rf+Rr).$$

ΔP1=ΔPch_a_1−ΔPch_b_1 and ΔPn=−ΔPch_a_n+ΔPch_b_n in the third embodiment when it is set that Pch_b_1−Pch_a_1=ΔP1 and Pch_a_n−Pch_b_n=ΔPn in FIG. 10.

Thus, ΔQbin_a can be calculated by ΔQbin_a=(ΔP1×M4+ΔPn×M2)/(M1×M4−M2×M3).

Further, ΔQbout_b can be calculated by ΔQbout_b=(ΔP1×M3+ΔPn×M1)/(M1×M4−M2×M3).

However, the fluid resistance Rbin_a of the bypass channel 191A and the fluid resistance Rbout_b of the bypass channel 191B are set as follows.

$$M1=\{Rf\times(Rbr1+Rbr3\times n+Rbr4)-Rr\times Rbf1\}/(Rf+Rr)$$

$$M2=\{Rf\times(Rbr1+Rbr4)-Rr\times Rbf1\}/(Rf+Rr)$$

$$M3=\{Rf\times Rbr4-Rr\times(Rbf1+Rbf2)\}/(Rf+Rr)$$

$$M4=[Rf\times Rbr4-Rr\times\{Rbf1+Rbf1+Rbf3\times(n-1)\}]/(Rf+Rr)$$

The head 100 according to a fourth embodiment of the present disclosure is described with reference to FIGS. 17 and 18.

Figure 17:
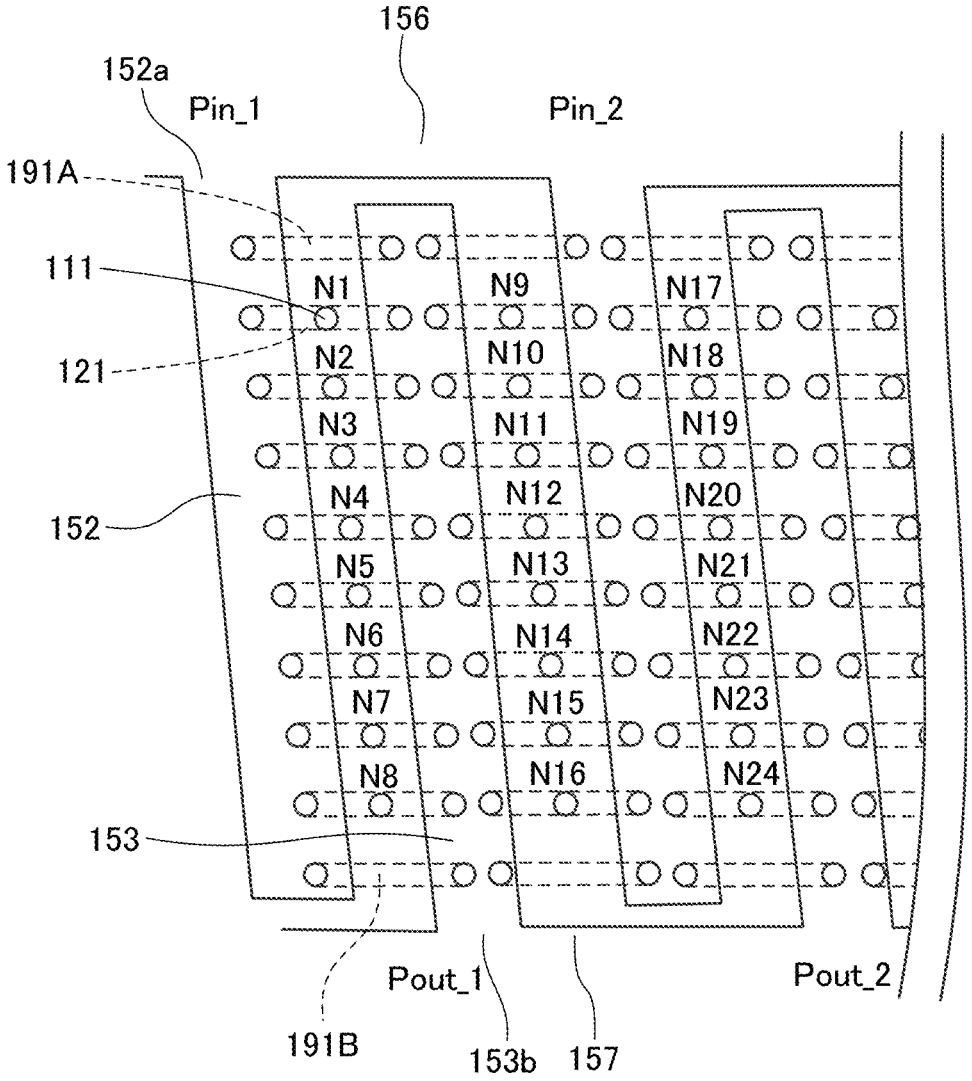
FIG. 17 is a schematic plan view of a channel configuration of the liquid discharge head according to a fourth embodiment of the present disclosure.

FIG. 17 is a schematic plan view of a channel configuration of the head 100 according to the fourth embodiment.

Figure 18:
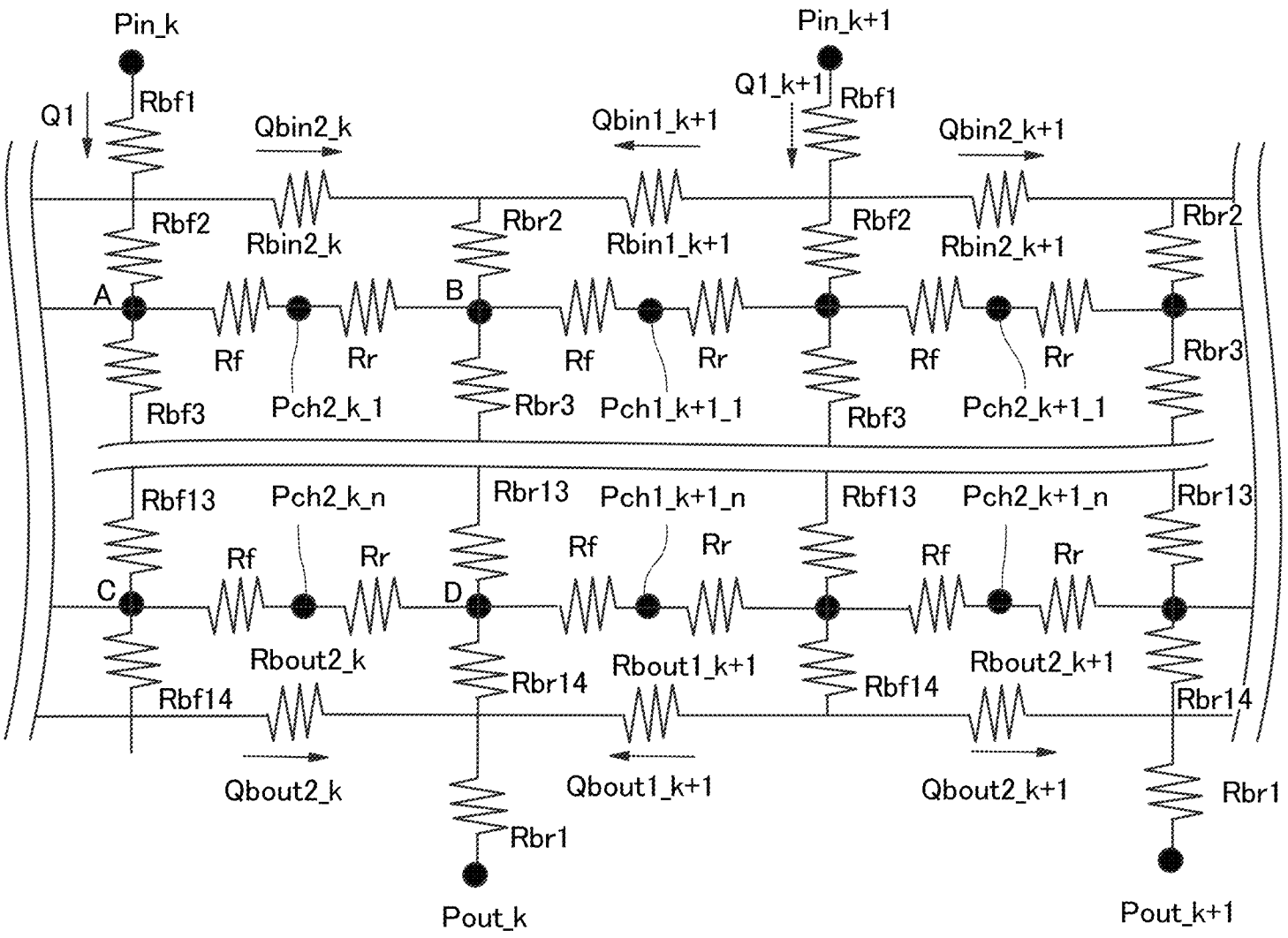
FIG. 18 is an equivalent circuit diagram of the liquid discharge head of FIG. 17 from the common-supply branch channel to the common-collection branch channel.

FIG. 18 is an equivalent circuit diagram of the head 100 of FIG. 17 from the common-supply branch channel 152 to the common-collection branch channel 153.

In the head 100 according to the fourth embodiment, the identical common-supply branch channel 152 communicates with different (multiple) common-collection branch channels 153 via the bypass channels 191A and 191B and the pressure chambers 121. The pressure chamber 121 includes the individual supply channel 122 and the individual collection channel 123. The individual supply channel 122 includes a fluid restrictor 122*a* having a higher fluid restriction than other parts of the individual supply channel 122. The individual collection channel 123 includes a fluid restrictor 123*a*. having a higher fluid restriction than other parts of the individual collection channel 123.

The multiple pressure chambers 121 include one group of multiple pressure chambers 121 arrayed in a flow direction different from the flow direction of the common-supply main channel 156. The one group of the multiple pressure chambers 121 connects the one of the multiple common-supply branch channels 152 and the one of the multiple common-collection branch channels 153.

Further, the identical common-collection branch channel 153 communicates with different (multiple) common-supply branch channels 152 via the bypass channels 191A and 191B and the pressure chambers 121. The pressure chamber 121 includes the individual supply channel 122 and the individual collection channel 123.

The identical one of the multiple common-supply branch channels 152 communicates with two of the multiple common-collection branch channels 153 disposed on both sides of the identical one of the multiple common-supply branch channels 152 via the bypass channels 191A and 191B and two groups of the multiple pressure chambers 121.

The identical one of the multiple common-collection branch channels 153 communicates with two of the multiple common-supply branch channels 152 disposed on both sides of the identical one of the multiple common-collection branch channels 153 via the bypass channels 191A and 191B and two groups of the multiple pressure chambers 121.

In other words, the common-supply branch channel 152 communicates with two common-collection branch channels 153 adjacent to both sides of the common-supply branch channel 152 via the bypass channels 191A and 191B and the pressure chambers 121 in the flow direction of the common-supply main channel 156. The pressure chamber 121 includes the individual supply channel 122 and the individual collection channel 123. Similarly, the common-collection branch channel 153 communicates with two common-supply branch channels 152 adjacent to both sides of the common-collection branch channel 153 via the bypass channels 191A and 191B and the pressure chambers 121 in the flow direction of the common-supply main channel 156. The pressure chamber 121 includes the individual supply channel 122 and the individual collection channel 123.

Referring to FIG. 18, in the head 100 according to the fourth embodiment, Pin_k>Pin_k+1 and Pout_k>Pout_k+1. Therefore, when Rbin2_k=Rbin1_k+1=Rbin2_k+1 and Rbout2_k=Rbout1_k+1=Rbout2_k+1, then Pch2_k_1>Pch1_k+1_1>Pch2_k+1_1 and Pch2_kn>Pch1_k+1_n>Pch2_k+1_n.

The amount of change in the meniscus pressure Pch2_k_1, when the fluid resistance Rbin2_k of the bypass channel 191A is changed, becomes $\Delta Pch2_k_1=\Delta Qbin_k\times\{Rf\times(Rbr1+Rbr3\times n+Rbr4)-Rr\times Rbf1\}/(Rf+Rr)$. The above equation is the same equation as described in the first embodiment. Thus, the head 100 according to the fourth embodiment can reduce variations in the meniscus pressure as in the first embodiment.

An amount of change in the meniscus pressure Pch2_k+1_n, when the fluid resistance Rbout2_k+1 of the bypass channel 191B is changed, becomes $\Delta Pch2_k+1n=\Delta Qbout_k\times\{Rf\times Rbr4-Rr\times(Rbf1+Rbf2+Rbf3\times n)\}/(Rf+Rr)$.

The above equation is the same equation as described in the second embodiment. The above equation becomes the equation similar to the second embodiment as similarly to the second embodiment. Thus, the head 100 according to the fourth embodiment can reduce variations in the meniscus pressure as in the second embodiment.

The fluid resistance Rbin2_k of the bypass channel 191A and the fluid resistance Rbout2_k+1 of the bypass channel 191B are changed. Thus, the head 100 according to the fourth embodiment can obtain operational effects as same as operation effects of the third embodiment in which the first embodiment and the second embodiment are combined.

Here, the k-th and the (k+1)-th have been described. Similar effects can be obtained with other combinations.

Next, an example of a printer 1 serving as a liquid discharge apparatus according to a fifth embodiment is described with reference to FIGS. 19 and 20.

Figure 19:
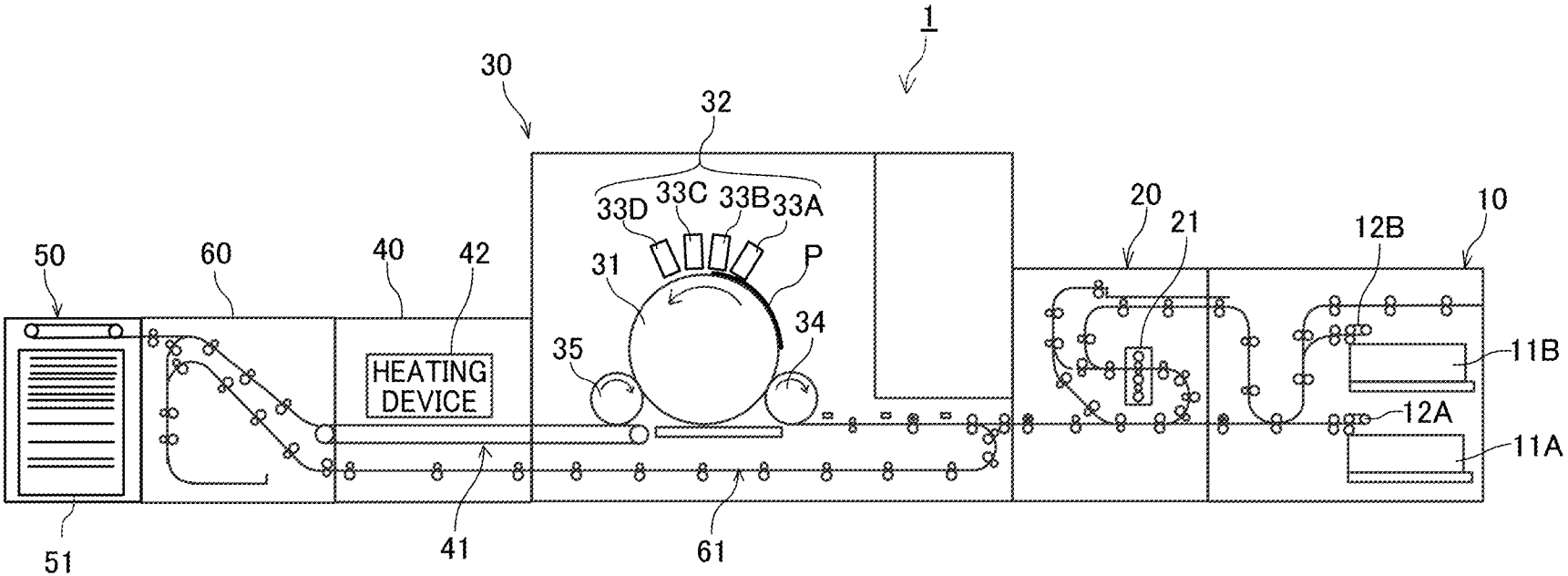
FIG. 19 is a schematic side view of a printer as a liquid discharge apparatus according to a fifth embodiment of the present disclosure.

FIG. 19 is a schematic cross-sectional side view of the printer 1 according to the fifth embodiment of the present disclosure.

Figure 20:
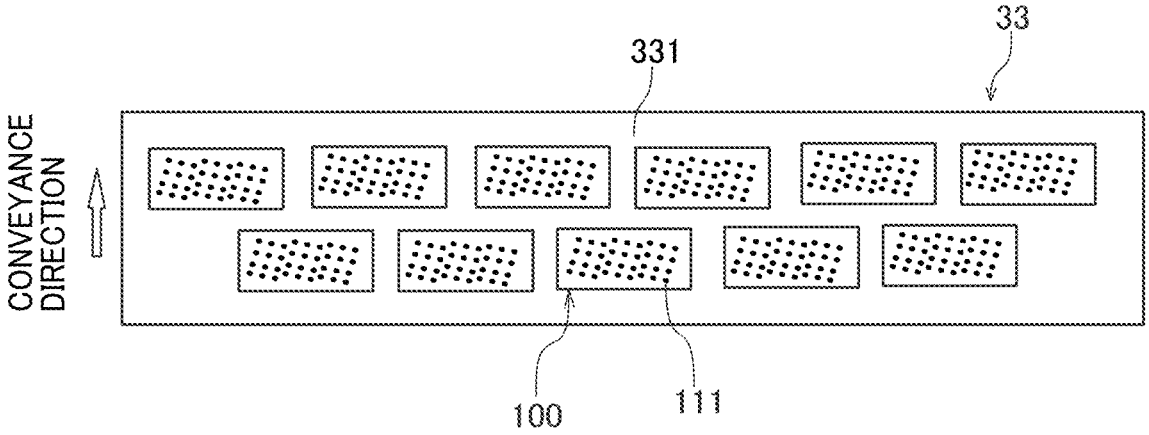
FIG. 20 is a plan view of a discharge unit of the printer.

FIG. 20 is a schematic plan view of a discharge unit 33 of the printer 1.

The printer 1 serves as the liquid discharge apparatus. The printer 1 includes a loading unit 10 to load a sheet P into the printer 1, a pretreatment unit 20, a printing unit 30, a dryer 40, a reverse mechanism 60 and an ejection unit 50.

In the printer 1, the pretreatment unit 20 applies, as desired, pretreatment liquid onto the sheet P fed (supplied) from the loading unit 10, the printing unit 30 applies liquid to the sheet P to perform desired printing, the dryer 40 dries the liquid adhering to the sheet P, and the sheet P is ejected to the ejection unit 50. The pretreatment unit 20 serves as a "pretreatment device".

The loading unit 10 includes loading trays 11 (a lower loading tray 11A and an upper loading tray 11B) to accommodate multiple sheets P and feeding devices 12 (a feeding device 12A and a feeding device 12B) to separate and feed the sheets P one by one from the loading trays 11, and supplies the sheets P to the pretreatment unit 20.

The pretreatment unit 20 includes, e.g., a coater 21 as a treatment-liquid application unit that coats a printing surface of a sheet P with a treatment liquid having an effect of aggregation of ink particles to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges liquids toward the sheet P borne on the drum 31.

The printing unit 30 further includes transfer cylinders 34 and 35. The transfer cylinder 34 receives the sheet P from the pretreatment unit 20 and forwards the sheet P to the drum 31. The transfer cylinder 35 receives the sheet P conveyed by the drum 31 and forwards the sheet P to the dryer 40.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes multiple suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) as liquid dischargers to discharge liquids. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K), respectively. Further, the discharge unit 33 may discharge a special liquid, that is, a liquid of spot color such as white, gold, or silver.

As illustrated in FIG. 20, for example, the discharge unit 33 is a full line head and includes multiple heads 100 according to the embodiments of the present disclosure. The multiple heads 100 are arranged in a staggered manner on a base 331. Each of the head 100 includes multiple nozzles 111 arranged in a two-dimensional matrix. multiple liquid discharge heads (100) arrayed on a base (331). The head 100 includes multiple heads 100 arrayed on the base 331.

A discharge operation of each of the discharge unit 33 of the liquid discharge device 32 is controlled by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed on the sheet P.

The drum 31 forwards the sheet P onto which a liquid is applied by the liquid discharge device 32 to the transfer cylinder 35. The transfer cylinder 35 forwards the sheet P fed from the drum 31 to a conveyor 41. The conveyor 41 conveys the sheet P to the dryer 40.

The dryer 40 serving as a drying device includes a heater 42 to heat and dry the sheet P conveyed by a conveyor 41. The dryer 40 dries the liquid adhered onto the sheet P by the printing unit 30. Thus, a liquid component such as moisture in the liquid evaporates, and the colorant contained in the liquid is fixed on the sheet P. Additionally, curling of the sheet P is restrained.

The reverse mechanism 60 reverses, in switchback manner, the sheet P that has passed through the dryer 40 in double-sided printing. The reversed sheet P is fed back to an upstream side of the transfer cylinder 34 through a duplex conveyance passage 61 of the printing unit 30.

The ejection unit 50 includes an ejection tray 51 on which a plurality of sheets P is stacked. The plurality of sheets P conveyed through the reverse mechanism 60 from the dryer 40 is sequentially stacked and held on the unloading tray 51.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The "liquid discharge device" is an assembly of parts relating to liquid discharge. The term "liquid discharge device" represents a structure including the head and a functional part(s) or unit(s) combined to the head to form a single unit.

For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another.

The liquid discharge head may be detachably attached to the functional part(s) or unit(s) s each other.

For example, the head and the head tank may form the liquid discharge device as a single unit.

Alternatively, the head and the head tank coupled (connected) with a tube or the like may form the liquid discharge device as a single unit.

A unit including a filter may be added at a position between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit.

The liquid discharge device may include the head, the carriage, and the main scan moving unit that form a single unit.

In still another example, a cap that forms a part of the maintenance unit may be secured to the carriage mounting the head so that the head, the carriage, and the maintenance unit form a single unit to form the liquid discharge device.

Further, in another example, the liquid discharge device includes a tube connected to the head mounting the head tank or the channel part so that the head and a supply unit form a single unit.

A liquid in a liquid reservoir source such as an ink cartridge is supplied to the head through this tube.

The main scan moving unit may be a guide only.

The supply unit may be a tube(s) only or a loading unit only.

Here, the "liquid discharge device" may be a single unit in which the head and other functional parts are combined with each other.

However, the "liquid discharge device" may include a head module including the above-described head, and a head device in which the above-described functional components and mechanisms are combined to form a single unit.

The term "liquid discharge apparatus" used herein also represents an apparatus including the head, the liquid discharge device, the head module, the head device, and the liquid discharge device to discharge liquid by driving the head.

The liquid discharge apparatus may be, for example, an apparatus capable of discharging a liquid to a material to which liquid can adhere or an apparatus to discharge liquid toward gas or into liquid.

The "liquid discharge apparatus" may include units to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material on which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and the material on which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

multiple nozzles arrayed in two-dimensional matrix, the multiple nozzles configured to discharge a liquid;

multiple pressure chambers respectively communicating with the multiple nozzles;

multiple common-supply branch channels, each communicating with the multiple pressure chambers;

multiple common-collection branch channels, each communicating with the multiple pressure chambers, the multiple common-collection branch channels respectively communicating with the multiple common-supply branch channels through the multiple pressure chambers;

a common-supply main channel communicating with each of the multiple common-supply branch channels;

a common-collection main channel communicating with each of the multiple common-collection branch channels; and two or more bypass channels communicating with the multiple common-supply branch channels and the multiple common-collection branch channels, wherein the multiple common-supply branch channels and the multiple common-collection branch channels are disposed alternately in a flow direction of the liquid in the common-supply main channel, and the two or more bypass channel includes:

a first bypass channel communicating with one of the multiple common-supply branch channels and one of the multiple common-collection branch channels; and a second bypass channel communicating with another of the multiple common-supply branch channels and another of the multiple common-collection branch channels, and a fluid resistance of the first bypass channel is different from a fluid resistance of the second bypass channel, wherein the common-supply main channel and the common-collection main channel are extending in the flow direction, the multiple common-supply branch channels and the multiple common-collection branch channels are extending in another flow direction different from the flow direction, one end of each of the multiple common-supply branch channels is connected to the common-supply main channel at an inlet, one end of each of the multiple common-collection branch channels is connected to the common-collection main channel at an outlet, another end of each of the multiple common-supply branch channels is in a vicinity of the common-collection main channel, each of the multiple common-supply branch channels configured to flow the liquid from the inlet toward said another end of each of the multiple common-supply branch channels in said another flow direction, another end of each of the multiple common-collection branch channels is in a vicinity of the common-supply main channel, each of the multiple common-collection branch channels configured to flow the liquid from said another end of each of the multiple common-collection branch channels toward the outlet in said another flow direction, the multiple pressure chambers include one group of multiple pressure chambers arrayed in said another flow direction, the one group of the multiple pressure chambers connecting the one of the multiple common-supply branch channels and the one of the multiple common-collection branch channels, and the first bypass channel includes:

a first upstream bypass channel in a vicinity of the inlet, the first upstream bypass channel disposed upstream of the one group of the multiple pressure chambers; and a first downstream bypass channel in a vicinity of the outlet, the first downstream bypass channel disposed downstream of the one group of the multiple pressure chambers, wherein each of the multiple pressure chambers extends in the flow direction, each of the multiple pressure chambers includes:

a supply-side individual channel upstream of one of the multiple nozzles in the flow direction; and a collection-side individual channel downstream of the one of the multiple nozzles in the flow direction, and a relation of $Rf \times R2 - Rr \times R1 > 0$ is satisfied, where:

Rf is a fluid resistance of the supply-side individual channel;

Rr is a fluid resistance of the collection-side individual channel;

R1 is a fluid resistance from the inlet to the first upstream bypass channel; and R2 is a fluid resistance from the outlet to the collection-side individual channel of most upstream pressure chamber in the one group of the multiple pressure chambers in said another flow direction.

2. A liquid discharge head comprising:

multiple nozzles arrayed in two-dimensional matrix, the multiple nozzles configured to discharge a liquid;

multiple pressure chambers respectively communicating with the multiple nozzles;

multiple common-supply branch channels, each communicating with the multiple pressure chambers;

multiple common-collection branch channels, each communicating with the multiple pressure chambers, the multiple common-collection branch channels respectively communicating with the multiple common-supply branch channels through the multiple pressure chambers;

a common-supply main channel communicating with each of the multiple common-supply branch channels;

a common-collection main channel communicating with each of the multiple common-collection branch channels; and two or more bypass channels communicating with the multiple common-supply branch channels and the multiple common-collection branch channels, wherein the multiple common-supply branch channels and the multiple common-collection branch channels are disposed alternately in a flow direction of the liquid in the common-supply main channel, and the two or more bypass channel includes:

a first bypass channel communicating with one of the multiple common-supply branch channels and one of the multiple common-collection branch channels; and a second bypass channel communicating with another of the multiple common-supply branch channels and another of the multiple common-collection branch channels, and a fluid resistance of the first bypass channel is different from a fluid resistance of the second bypass channel, wherein the common-supply main channel and the common-collection main channel are extending in the flow direction, the multiple common-supply branch channels and the multiple common-collection branch channels are extending in another flow direction different from the flow direction, one end of each of the multiple common-supply branch channels is connected to the common-supply main channel at an inlet, one end of each of the multiple common-collection branch channels is connected to the common-collection main channel at an outlet, another end of each of the multiple common-supply branch channels is in a vicinity of the common-collection main channel, each of the multiple common-supply branch channels configured to flow the liquid from the inlet toward said another end of each of the multiple common-supply branch channels in said another flow direction, another end of each of the multiple common-collection branch channels is in a vicinity of the common-supply main channel, each of the multiple common-collection branch channels configured to flow the liquid from said another end of each of the multiple common-collection branch channels toward the outlet in said another flow direction, the multiple pressure chambers include one group of multiple pressure chambers arrayed in said another flow direction, the one group of the multiple pressure chambers connecting the one of the multiple common-supply branch channels and the one of the multiple common-collection branch channels, and the first bypass channel includes:

a first upstream bypass channel in a vicinity of the inlet, the first upstream bypass channel disposed upstream of the one group of the multiple pressure chambers; and a first downstream bypass channel in a vicinity of the outlet, the first downstream bypass channel disposed downstream of the one group of the multiple pressure chambers, wherein each of the multiple pressure chambers extends in the flow direction, each of the multiple pressure chambers includes:

a supply-side individual channel upstream of one of the multiple nozzles in the flow direction; and a collection-side individual channel downstream of the one of the multiple nozzles in the flow direction, and a relation of $Rf \times R4 - Rr \times R3 < 0$ is satisfied, where:

Rf is a fluid resistance of the supply-side individual channel;

Rr is a fluid resistance of the collection-side individual channel;

R3 is a fluid resistance from the inlet to the supply-side individual channel of most downstream pressure chamber in the one group of the multiple pressure chambers in said another flow direction; and R4 is a fluid resistance from the outlet to the first downstream bypass channel.

3. A liquid discharge device comprising:

a base; and the liquid discharge head according to claim 1 on the base, wherein the liquid discharge head includes multiple liquid discharge heads arrayed on the base.

4. A liquid discharge apparatus comprising:

the liquid discharge device according to claim 3.

5. A liquid discharge device comprising:

a base; and the liquid discharge head according to claim 2 on the base, wherein the liquid discharge head includes multiple liquid discharge heads arrayed on the base.

6. A liquid discharge apparatus comprising:

the liquid discharge device according to claim 5.

* * * * *